US009856822B2

(12) United States Patent
Schenkel et al.

(10) Patent No.: US 9,856,822 B2
(45) **Date of Patent: *Jan. 2, 2018**

(54) WELDED ENGINE BLOCK FOR SMALL INTERNAL COMBUSTION ENGINES

(71) Applicant: Briggs & Stratton Corporation, Wauwatosa, WI (US)

(72) Inventors: Jerry Schenkel, Pewaukee, WI (US); Gary D. Greenlees, Brookfield, WI (US); Claude Hoerig, Cedarburg, WI (US); Mike L. Carlson, Hubertus, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/426,916

(22) Filed: Feb. 7, 2017

(65) Prior Publication Data

US 2017/0145953 A1 May 25, 2017

Related U.S. Application Data

(63) Continuation of application No. 14/569,020, filed on Dec. 12, 2014, now Pat. No. 9,581,106, which is a (Continued)

(51) Int. Cl.

| | |
|---|---|
| ***F02F 7/00*** | (2006.01) |
| ***F02F 1/04*** | (2006.01) |
| ***F02F 1/28*** | (2006.01) |

(52) U.S. Cl.

CPC ..... *F02F 7/0039* (2013.01); *F02F 1/04* (2013.01); *F02F 1/28* (2013.01); *F02F 7/0012* (2013.01);

(Continued)

(58) Field of Classification Search

CPC .... F02F 1/04; F02F 1/28; F02F 7/0012; F02F 7/0004; F02F 7/0039; F02F 7/0085;

(Continued)

(56) References Cited

U.S. PATENT DOCUMENTS 2,208,750 A 7/1940 De Long
2,218,332 A 10/1940 Fowler (Continued)

FOREIGN PATENT DOCUMENTS

AU 2003200621 B2 9/2006
CN 2934608 8/2007

(Continued)

OTHER PUBLICATIONS

International Search Report and Written Opinion for PCT Application No. PCT/US2014/045788, dated Sep. 23, 2014, 9 pages.

(Continued)

*Primary Examiner* — Grant Moubry
(74) *Attorney, Agent, or Firm* — Foley & Lardner LLP

(57) ABSTRACT

A small air-cooled internal combustion engine includes an aluminum cylinder block, an aluminum cylinder head welded to the aluminum cylinder block, and a weld securing the aluminum cylinder block to the aluminum cylinder head, wherein a joint having a first length is formed between the aluminum cylinder block and the aluminum cylinder head and wherein the weld extends for a second length that is at least 25% of the first length.

20 Claims, 24 Drawing Sheets

Related U.S. Application Data continuation-in-part of application No. 14/326,185, filed on Jul. 8, 2014.

(60) Provisional application No. 61/844,364, filed on Jul. 9, 2013, provisional application No. 61/991,275, filed on May 9, 2014.

(52) U.S. Cl.
CPC ..... *F02F 7/0085* (2013.01); *F02B 2275/02* (2013.01)

(58) Field of Classification Search
CPC ..... F02F 7/0034; F02B 63/02; F02B 2275/02; B23P 15/00; B23P 6/02
USPC ..... 123/195 R, 193.3, 193.2; 29/888.06
See application file for complete search history.

(56) References Cited

U.S. PATENT DOCUMENTS

| | | | | |
|---|---|---|---|---|
| 2,650,578 | A | 9/1953 | Daub | |
| 2,769,226 | A | 11/1956 | Deventer | |
| 3,133,178 | A | 5/1964 | Thomas | |
| 3,978,840 | A * | 9/1976 | Schleiermacher | F02F 1/002 123/193.3 |
| 4,213,440 | A | 7/1980 | Abe et al. | |
| 4,469,060 | A | 9/1984 | Jordan | |
| 4,505,238 | A | 3/1985 | Jordan | |
| 4,509,472 | A | 4/1985 | Slattery | |
| 4,513,702 | A | 4/1985 | Koga et al. | |
| 4,762,098 | A | 8/1988 | Tamba et al. | |
| RE34,339 | E | 8/1993 | Wade et al. | |
| 5,586,530 | A | 12/1996 | Adachi et al. | |
| 5,649,358 | A | 7/1997 | Adachi et al. | |
| 5,742,020 | A | 4/1998 | Adachi et al. | |
| 5,745,993 | A | 5/1998 | Adachi et al. | |
| 5,755,194 | A | 5/1998 | Moorman et al. | |
| 5,768,779 | A | 6/1998 | Adachi | |
| 5,778,531 | A | 7/1998 | Inami et al. | |
| 5,787,853 | A | 8/1998 | Adachi et al. | |
| 5,802,716 | A | 9/1998 | Nishimura et al. | |
| 5,937,836 | A | 8/1999 | Yonezawa et al. | |
| 6,032,635 | A | 3/2000 | Moorman et al. | |
| 6,164,661 | A * | 12/2000 | Kakuta | F02F 11/002 219/117.1 |
| 6,250,273 | B1 | 6/2001 | Ryu et al. | |
| 6,330,871 | B1 | 12/2001 | Jufuku et al. | |
| 6,536,397 | B2 | 3/2003 | Mizutani | |
| 6,668,530 | B2 | 12/2003 | Kern et al. | |
| 6,715,770 | B2 * | 4/2004 | Schmitt | F02F 11/002 277/591 |
| 6,827,068 | B1 | 12/2004 | Sakata et al. | |
| 6,923,363 | B2 | 8/2005 | Masuda | |
| 7,568,515 | B2 | 8/2009 | Yoshihara et al. | |
| 7,594,488 | B2 | 9/2009 | Yoshijima et al. | |
| 7,677,217 | B2 | 3/2010 | Kumar et al. | |
| 7,958,814 | B2 | 6/2011 | Blythe et al. | |
| 8,459,175 | B2 | 6/2013 | Blythe et al. | |
| 8,794,220 | B2 | 8/2014 | Shiraishi et al. | |
| 2005/0076862 | A1 | 4/2005 | Satou | |
| 2006/0219331 | A1 | 10/2006 | Kinney et al. | |
| 2011/0017166 | A1 | 1/2011 | Schneiker | |
| 2012/0067307 | A1 * | 3/2012 | Sato | F01P 3/14 123/41.79 |
| 2014/0109863 | A1 | 4/2014 | Vaughn et al. | |

FOREIGN PATENT DOCUMENTS

| | | | | |
|---|---|---|---|---|
| CN | 101218366 | A | 7/2008 | |
| CN | 101644207 | A | 2/2010 | |
| DE | 10 98 288 | B | 1/1961 | |
| DE | 11 34 553 | B | 8/1962 | |
| DE | 70 24 839 | U | 10/1970 | |
| DE | 19533107 | A1 | 3/1996 | |
| DE | 19757286 | C2 | 4/2000 | |
| DE | 10 2012 213 356 | A1 | 5/2014 | |
| EP | 0 839 992 | A1 | 5/1998 | |
| EP | 1 039 099 | A1 | 9/2000 | |
| EP | 1 201 883 | A2 | 5/2002 | |
| EP | 1 947 319 | A2 | 7/2008 | |
| EP | 2 112 360 | | 10/2009 | |
| EP | 2 112 360 | A1 | 10/2009 | |
| FR | 2515729 | A1 | 5/1983 | |
| GB | 587889 | A * | 5/1947 | F02F 1/065 |
| GB | 1 383 879 | A | 2/1974 | |
| GB | 2 173 547 | A | 10/1986 | |
| JP | S61-229906 | A | 10/1986 | |
| JP | S62-191605 | A | 8/1987 | |
| JP | H05-149194 | | 6/1993 | |
| JP | H10-121921 | | 5/1998 | |
| JP | 2003-214173 | | 7/2003 | |
| WO | WO-2009/120405 | | 10/2009 | |

OTHER PUBLICATIONS

International Search Report and Written Opinion for PCT Application No. PCT/US2015/059555, dated Jan. 25, 2016, 11 pages.

International Search Report and Written Opinion, PCT/US2016/067296, Briggs & Stratton Corporation, 13 pages (dated Mar. 31, 2017).

Irving, R., "New Process Yields Tough Die Castings: Alcoa's Technology Seen Cost-Effective," Metalworking News, vol. 17, No. 782, pp. 1-2 (Apr. 23, 1990).

* cited by examiner

WELDED ENGINE BLOCK FOR SMALL INTERNAL COMBUSTION ENGINES

CROSS-REFERENCE TO RELATED PATENT APPLICATIONS

This application is a continuation of U.S. application Ser. No. 14/569,020, filed Dec. 12, 2014, which is a continuation-in-part of U.S. application Ser. No. 14/326,185, filed Jul. 8, 2014, which claims the benefit of U.S. Provisional Application No. 61/844,364, filed Jul. 9, 2013, and the benefit of U.S. Provisional Application No. 61/991,275, filed May 9, 2014, all of which are incorporated herein by reference in their entireties.

BACKGROUND

The present invention relates generally to the field of small air-cooled internal combustion engines, and particularly to the field of engine blocks for small air-cooled internal combustion engines.

SUMMARY

One embodiment of the invention relates to a small air-cooled internal combustion engine including an aluminum cylinder block, an aluminum cylinder head welded to the aluminum cylinder block, and a weld securing the aluminum cylinder block to the aluminum cylinder head, wherein a joint having a first length is formed between the aluminum cylinder block and the aluminum cylinder head and wherein the weld extends for a second length that is at least 25% of the first length.

Another embodiment of the invention relates to a small air-cooled internal combustion engine including an aluminum cylinder block, an aluminum cylinder head welded to the aluminum cylinder block, and a weld securing the aluminum cylinder block to the aluminum cylinder head, wherein a joint is formed between the aluminum cylinder block and the aluminum cylinder head, wherein the joint extends between an exterior surface of the aluminum cylinder block and the aluminum cylinder head and an interior surface of the aluminum cylinder block and the aluminum cylinder head, and wherein the weld extends from the exterior surface toward the interior surface.

Alternative exemplary embodiments relate to other features and combinations of features as may be generally recited in the claims.

BRIEF DESCRIPTION OF THE DRAWINGS

The disclosure will become more fully understood from the following detailed description, taken in conjunction with the accompanying figures.

DETAILED DESCRIPTION

Before turning to the figures, which illustrate the exemplary embodiments in detail, it should be understood that the application is not limited to the details or methodology set forth in the description or illustrated in the figures. It should also be understood that the terminology is for the purpose of description only and should not be regarded as limiting.

Figure 1:
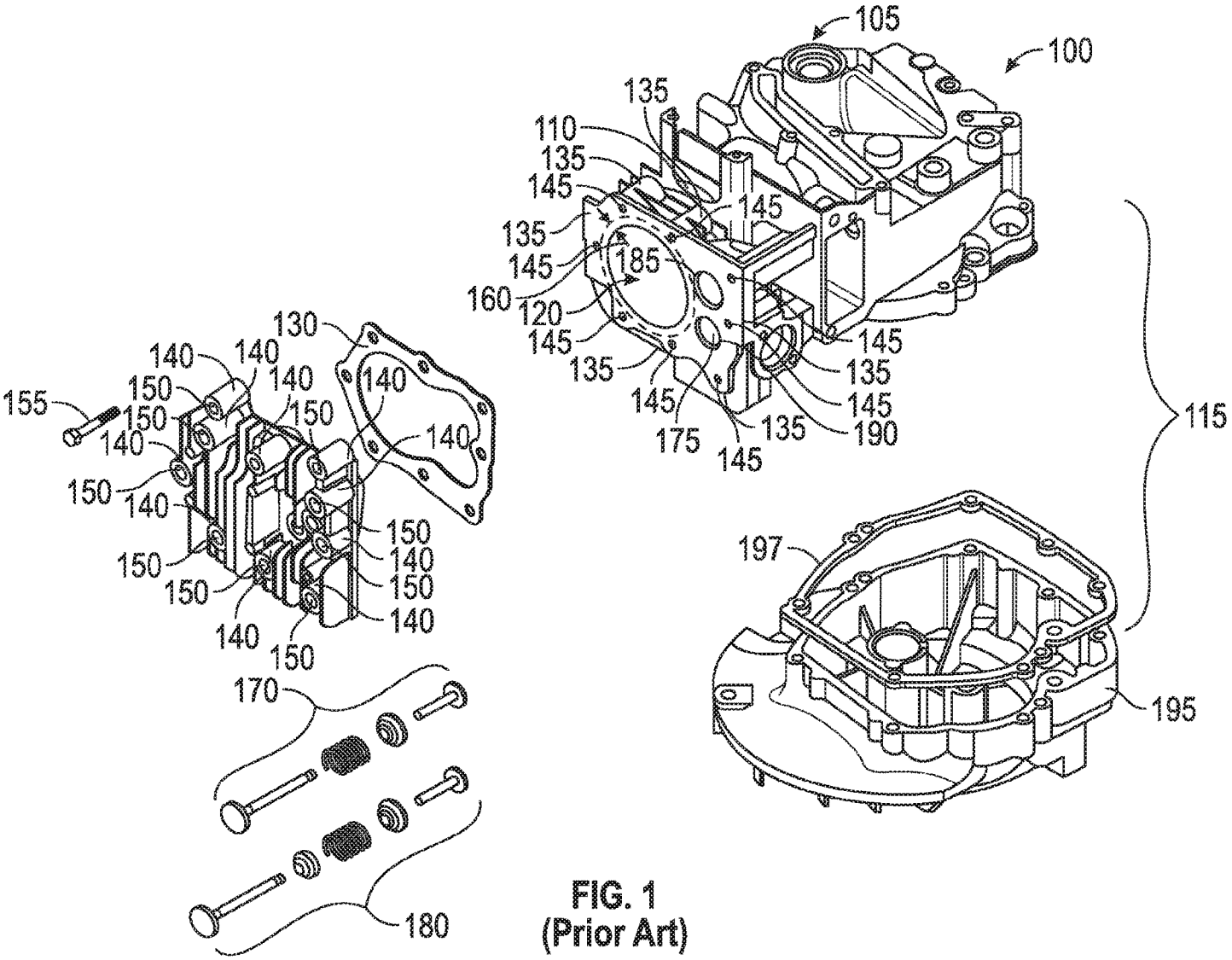
FIG. 1 (Prior Art)
FIG. 1 is an exploded perspective view of a standard small air-cooled engine, according to an exemplary embodiment.
Figure 2:
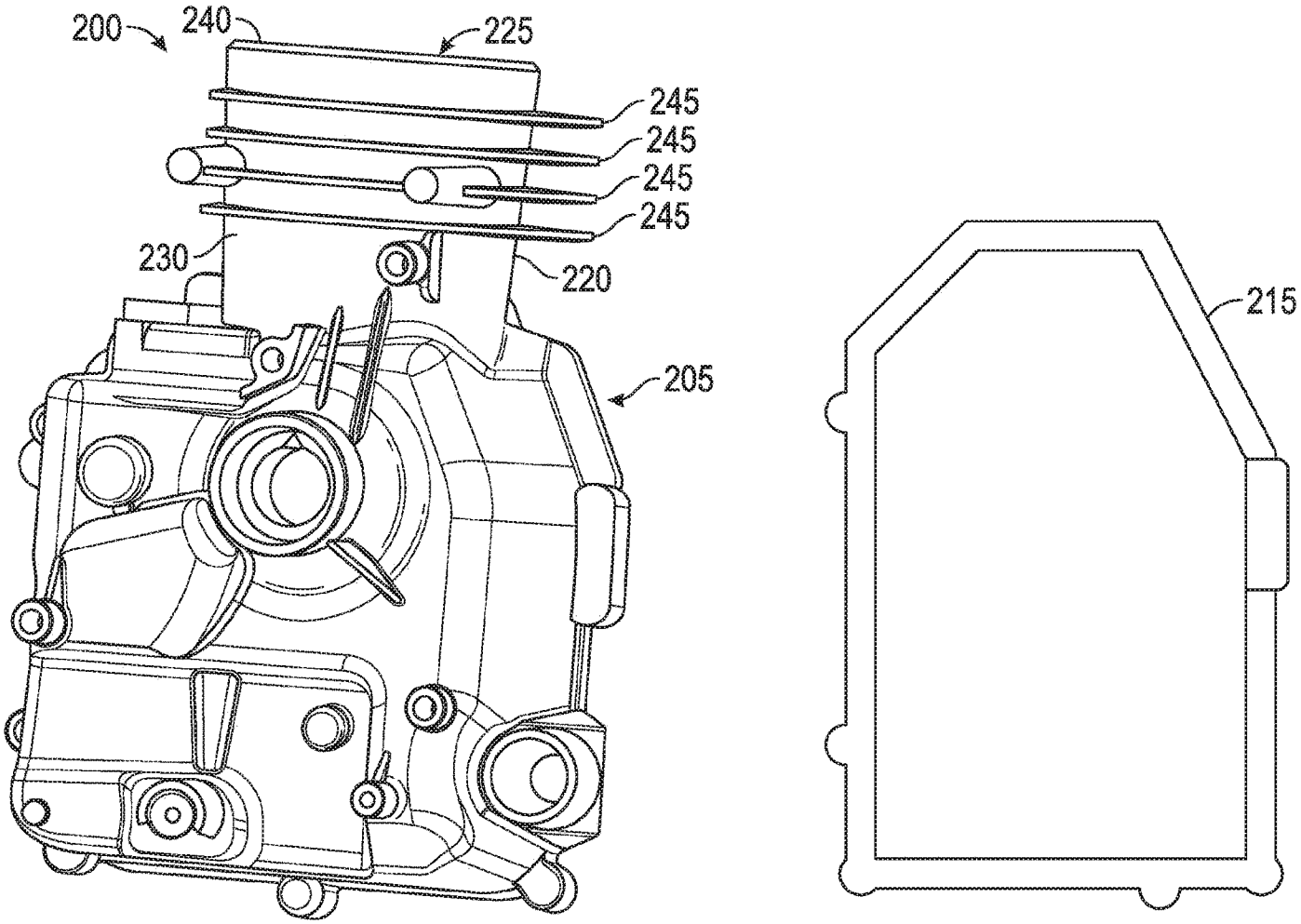
FIG. 2 is an exploded perspective view of an engine block and crankcase cover, according to an exemplary embodiment.
Figure 3:
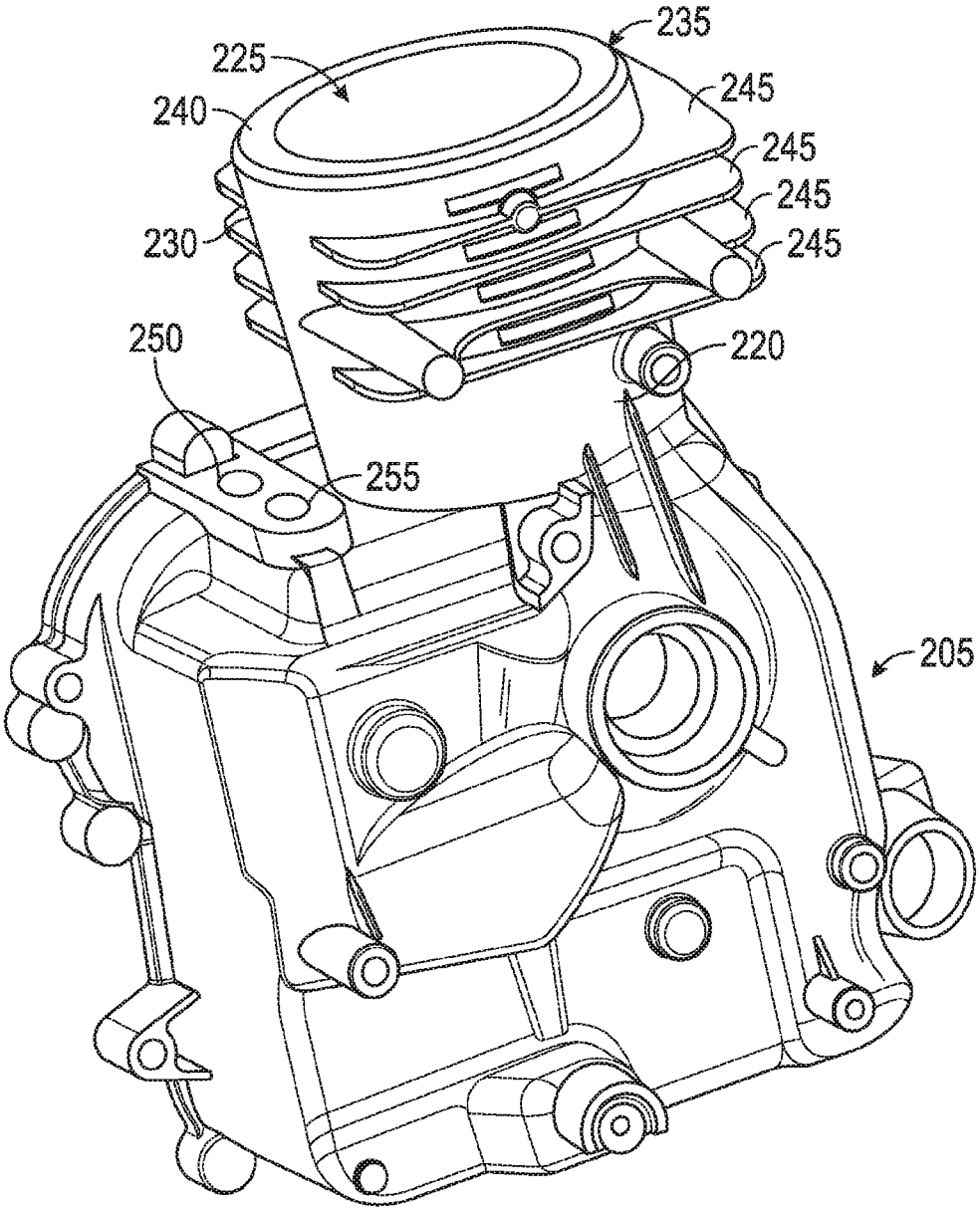
FIG. 3 is a perspective view of the engine block of FIG. 2.
Figure 4:
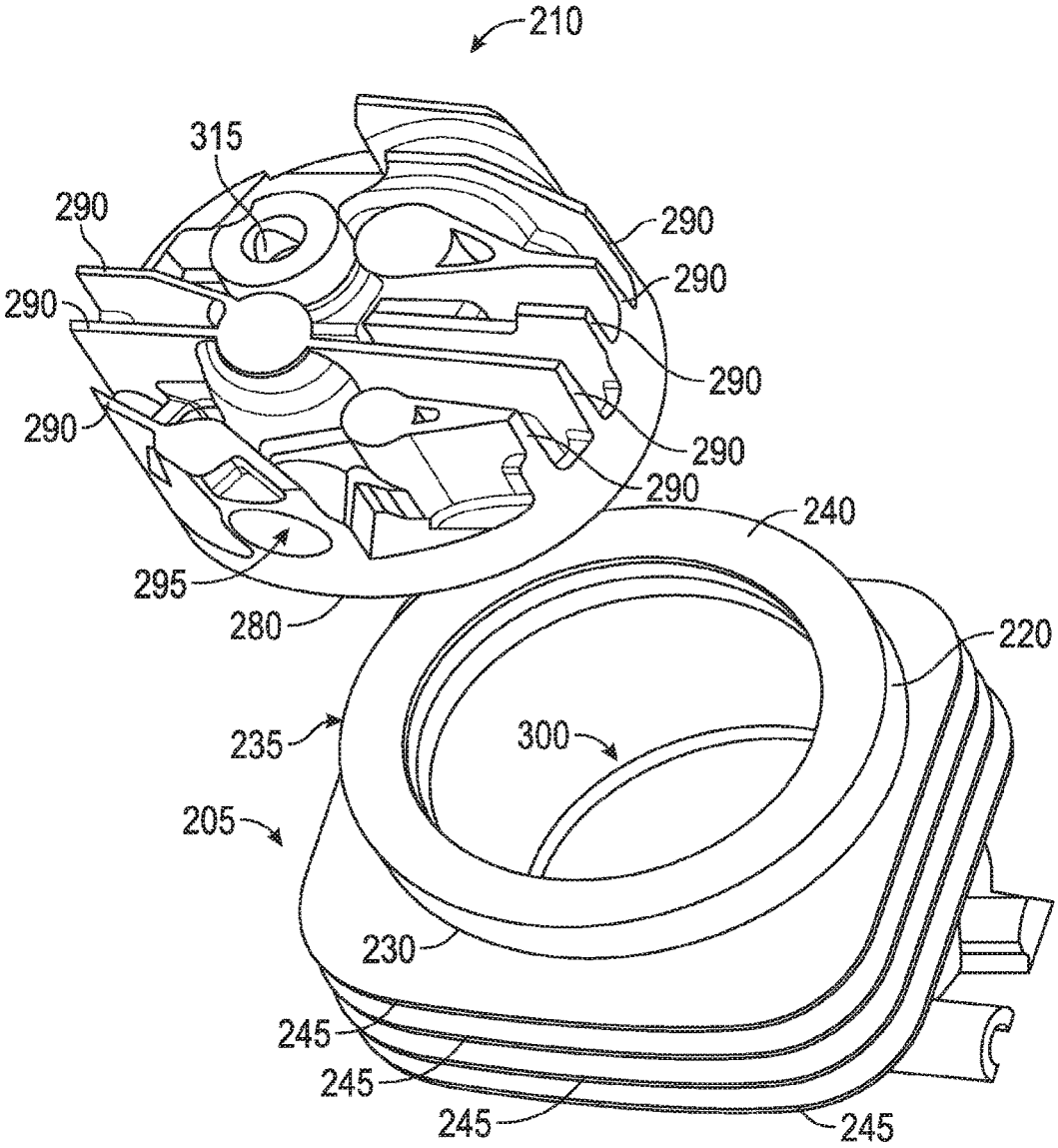
FIG. 4 is an exploded perspective view of the engine block of FIG. 2 and a cylinder head.
Figure 5:
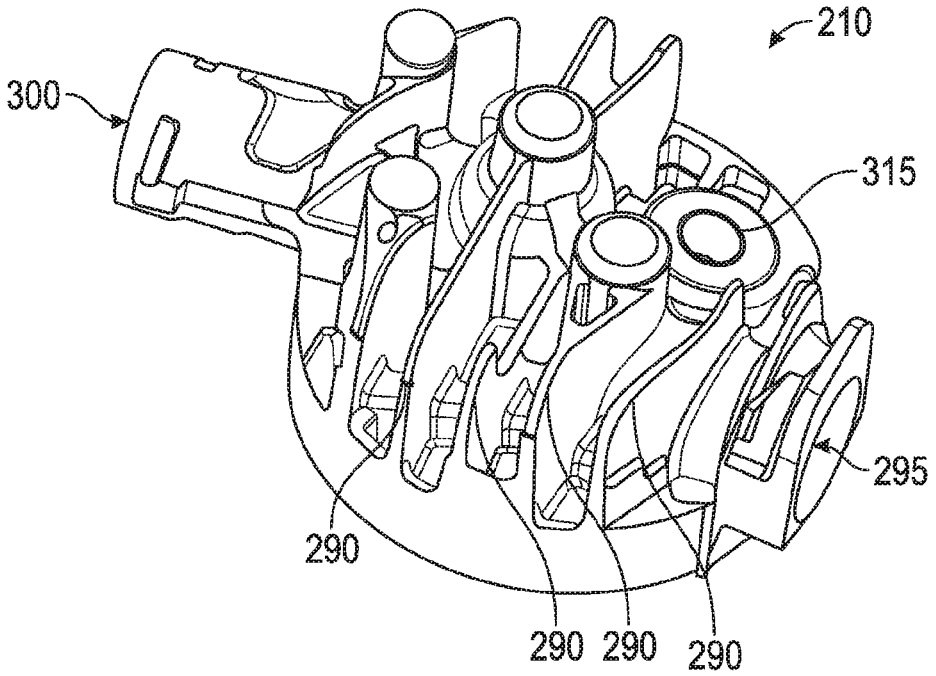
FIG. 5 is a perspective view from above of the cylinder head of FIG. 4.
Figure 6:
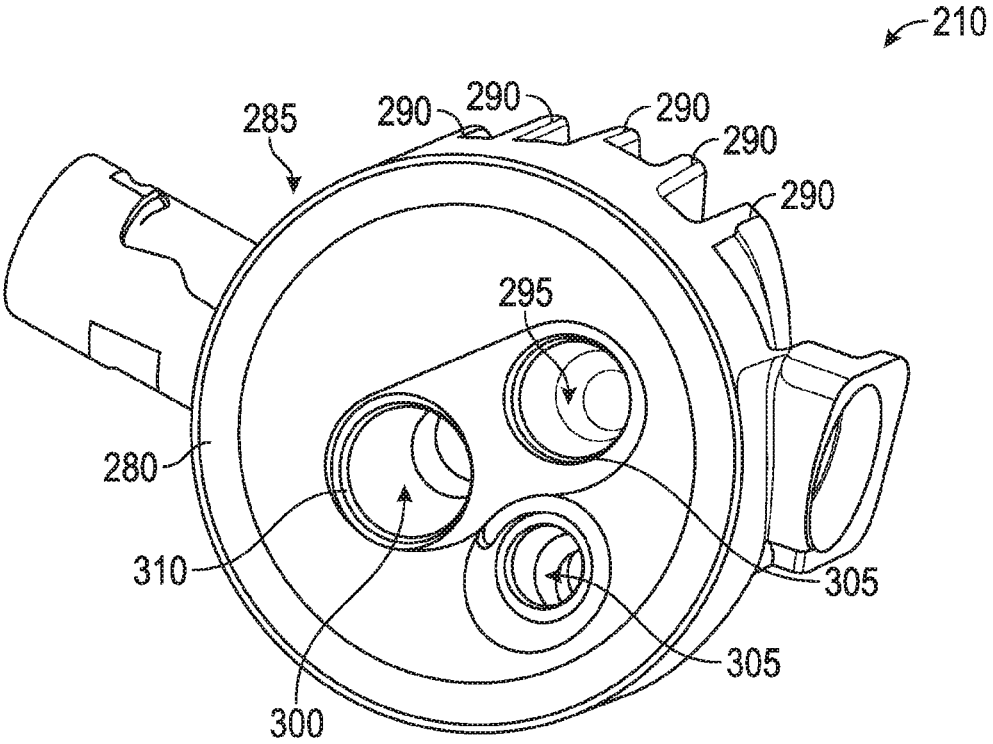
FIG. 6 is a perspective view from below of the cylinder head of FIG. 4.

Referring to FIG. 1, a standard small air-cooled engine 100 is illustrated. The engine 100 includes an engine block 105 having a cylinder block 110 and a crankcase 115. The cylinder block 110 includes one or more cylinder bores 120, each receiving a piston. A cylinder head 125 is fastened to the cylinder block 110 above the cylinder bore 120 to close the cylinder bore 120. A head gasket 130 is positioned between the cylinder head 125 and the cylinder block 110 to seal the connection between the cylinder block 110 and the cylinder head 125. The cylinder block 110 and the cylinder head 125 each include multiple mounting locations or bosses 135, 140 positioned around the cylinder bore 120. A mounting aperture or opening 145, 150 is formed through each of the mounting locations 135, 140, respectively, and a bolt 155 is inserted through each pair of apertures 145, 150 to secure the cylinder head 125 to the cylinder block 110. As shown in FIG. 1, four bolts 155 are used to secure the cylinder head 125 to the cylinder block 110. The mounting apertures 145, 150 are located outside of a cylinder wall thickness 160. The cylinder wall thickness 160 is substantially constant for the length of the cylinder bore 120. Cooling fins may extend from the outer surface of the cylinder wall.

The cylinder block 110 also includes an intake port 165 in which an intake valve 170 is positioned and an exhaust port 175 in which an exhaust valve 180 is positioned. A valve seat 185, 190 is press fit to the cylinder block 110 around an aperture (e.g., opening) to each of the intake port 165 and the exhaust port 175.

The crankcase 115 houses the crankshaft to which the piston is coupled and also acts as a reservoir for lubricant (e.g., oil) for the internal components of the engine 100. The crankcase 115 includes a crankcase cover or sump 195 that is fastened to the engine block 105 to close the crankcase 115 (e.g., with multiple bolts). The crankcase cover 195 is removable to provide access to the internal components of the engine 100. A crankcase gasket 197 is positioned between the cylinder block 110 and the crankcase cover 165 to seal the connection between the cylinder block 110 and the crankcase cover 165.

The connections between the cylinder block 110 and the cylinder head 125 and between the engine block 105 and the crankcase cover 165 provide locations for possible leaks (e.g., of air, fuel-air mixture, oil, etc.) into or out of the engine block 105. Also, the locations at or near these connections, particularly between the cylinder block 110 and the cylinder head 125 (e.g., at the mounting locations 135, 140) require a substantial mass of material in order to make the connection. The substantial mass is necessary to minimize potential adverse effects of the clamping force needed to secure the cylinder head 125 to the cylinder bock 110. The shape and mass of the material used in the mounting locations 135, 140 is, at least in part, determined by the need to minimize or control the amount of distortion caused to the cylinder bore 120 when the cylinder head 125 is bolted to the cylinder block 110. Such distortion (e.g., of the roundness and/or eccentricity of the cylinder bore 120) can result in leaks into or out of the cylinder bore 120 (e.g., to or from the crankcase 115).

The substantial mass of the mounting locations 135, 140 also can cause failure modes related to heat transfer at these locations. For example, thermal expansion at and near the mounting locations 135, 140 and the sealing surfaces of the cylinder block 110 and the cylinder head 125 during use of the engine 100 and the subsequent cooling of these areas when the engine 100 is stopped may result in a reduced clamping force between the cylinder block 110 and the cylinder head 125 (e.g., due to stretched bolts 155 causing a "loose" cylinder head 125). This reduced clamping force may result in the head gasket 130 being unable to maintain a good seal and allowing leaks past the head gasket 130. Air leaks into the cylinder bore 120 increase combustion gas temperatures, which may cause the engine 100 to overheat. In some cases, the overheating may cause distortion of the cylinder block 110 (e.g., of the cylinder bore 120). As another example, difficulty in cooling the substantial mass of the mounting locations 135, 140 and/or the locations around the valves 170, 180 may result in distortion of the cylinder bore 120 and/or loosening or dislodging a valve seat insert due to excessive temperature variations. When the engine 100 is running hotter than normal engine temperatures, the cylinder bore 120 expands and may distort (e.g., near the exhaust valves). Distortion of the cylinder bore 120 may prevent the piston rings from forming a proper seal, thereby providing combustion gases a path to the crankcase. Distortion of the cylinder bore 120 near a valve 170, 180 may cause the valve seat 185, 190 to loosen or dislodge due to differences between thermal expansion of the portion of the cylinder block 110 surrounding the valve seat and of the valve seat 185, 190 itself.

Eliminating bolted connections or other fastened connections between the cylinder block 110 and the cylinder head 125 and between the engine block 105 and the crankcase cover 195 would help to reduce failure modes related to clamping forces, thermal expansion, and leaks between these components and allow reduction in the substantial mass of material needed at these locations to allow for bolted connections. Welded connections between the cylinder block 110 and the cylinder head 125 and between the engine block 105 and the crankcase cover 195 would help to reduce the shortcomings of the bolted connections. However, aluminum, which is a preferred material for engine blocks, cylinder heads, and crankcase covers, can be difficult to weld.

Advances in aluminum die-casting allow for die-cast engine blocks, cylinder heads, and crankcase covers having material properties suitable for welding. In particular, the hydrogen gas porosity of the aluminum must be reduced in order to allow welding. In some embodiments, aluminum (e.g., die-cast aluminum) is capable of being welded when the gas porosity of the cast aluminum is 0.30 milliliters per 100 grams of aluminum or less. In other embodiments, gas porosity of the cast aluminum is 0.15 milliliters per 100 grams of aluminum or less. Using the E505 ASTM standard for casting priority, levels 1 or 2 are preferred, with level 3 also likely to be acceptable. Level 4 is not believed to be acceptable.

Gas porosity can be reduced by melting the aluminum covered by an inert gas, in an environment of low-solubility gases (e.g., argon, carbon dioxide, etc.) or under a flux that prevents contact between the aluminum and air. Gas porosity can be reduced in several ways during the casting process. Turbulence from pouring the liquid aluminum into a mold can introduce gases into the molten aluminum, so the mold may be designed to minimize such turbulence. Advances in electronic control of the casting process, particularly for die casting, allow for relatively slow injection of molten aluminum into the die and finite control of the injection process, which results in cast aluminum having relatively low levels of gas porosity. Additionally, various vacuum die-casting techniques in which a vacuum is drawn in the mold prior to and/or during injection of the molten aluminum into the mold may result in cast aluminum having relatively low levels of porosity.

Referring to FIGS. 2-6, portions of a small air-cooled vertical-shaft internal combustion engine 200 are illustrated. The engine 200 includes an engine block 205, a cylinder head 210, and a crankcase cover 215. The cylinder head 210 is welded to the engine block 205 and the crankcase cover 215 is welded to the engine block 205. In some embodiments, these components are laser welded to one another. In other embodiments, these components are friction-stir welded to one another. In other embodiments, these components are MIG or TIG welded to one another. In some embodiments, the cylinder head 210 is welded to the engine block 205 and the crankcase cover 215 is fastened to the engine block 205 by other means (e.g., bolted, fastened by adhesive, etc.). In other embodiments, the crankcase cover 215 is welded to the engine block 205 and the cylinder head 210 is fastened to the engine block 205 by other means (e.g., bolted, fastened by adhesive, etc.). Alternatively, a small air-cooled horizontal-shaft engine includes an aluminum engine block and one or more aluminum cylinder heads.

Welding these connections eliminates the possible leak points at these connections. Eliminating these possible leak points results in the engine 200 consuming less oil and operating at a lower oil temperature than standard small air-cooled engines. In some embodiments, the engine 200 may consume one-half of the oil consumed by a standard small air-cooled engine. Reduced oil consumption also reduces maintenance intervals (e.g., time between oil changes).

The engine block 205 includes a cylinder block 220. The cylinder block 220 includes one or more cylinder bores 225, each receiving a piston. A cylinder wall 230 has a cylinder wall thickness 235. In some embodiments, the cylinder wall thickness 235 is substantially constant. An end face or mounting surface 240 of the cylinder block 220 is configured to mate with (e.g., engage, abut) the cylinder head 210 so that the cylinder head 210 may be welded to the cylinder block 220. One or more cooling fins 245 extend from the outer surface of the cylinder wall 230. In some embodiments, the cooling fins 245 surround all 360° of the cylinder wall 230. In other embodiments, the cooling fins cover less than 360° of the cylinder wall 230 (e.g., 330°, 315°, 300°, 270°, etc.).

Figure 8:
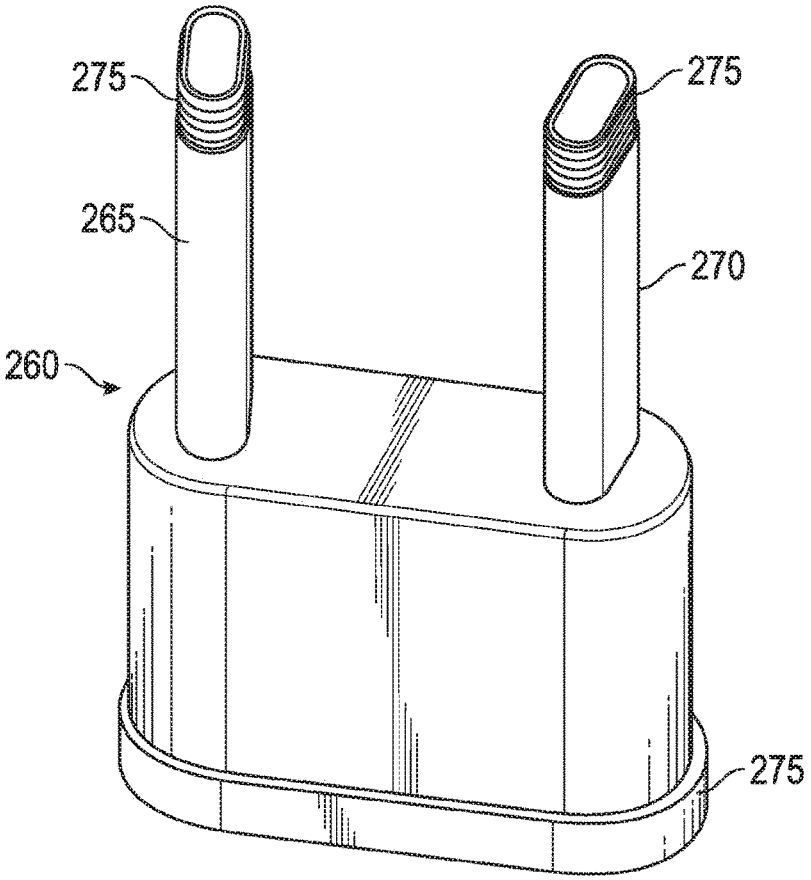
FIG. 8 is a perspective view of push rod housing, according to an exemplary embodiment.
Figure 9:
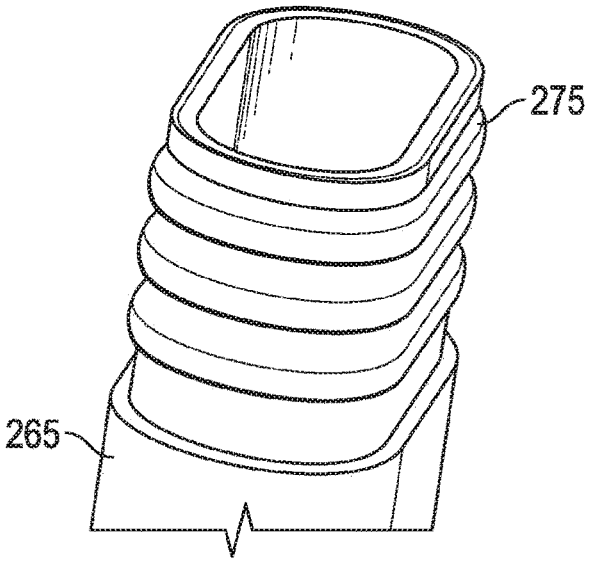
FIG. 9 is a detail view of a portion of the push rod housing of FIG. 8.

Two push rod openings 250, 255 are formed in the engine block 205 to allow each push rod to extend from the camshaft to a rocker arm. A push rod housing 260 (illustrated in FIGS. 8-9) is secured and sealed to the engine block 205. The push rod housing 260 surrounds and protects the push rods. The push rod housing includes two guide tubes 265, 270. A push rod is positioned within each guide tube 265, 270. In some embodiments, the push rod housing 260 is formed of plastic with overmolded gaskets 275 (e.g., rubber gaskets) at the connection points between the housing 260 and the engine block 205 and the valve cover. In some embodiments, the gaskets 275 are formed in other appropriate ways and/or from other appropriate materials.

Figure 7:
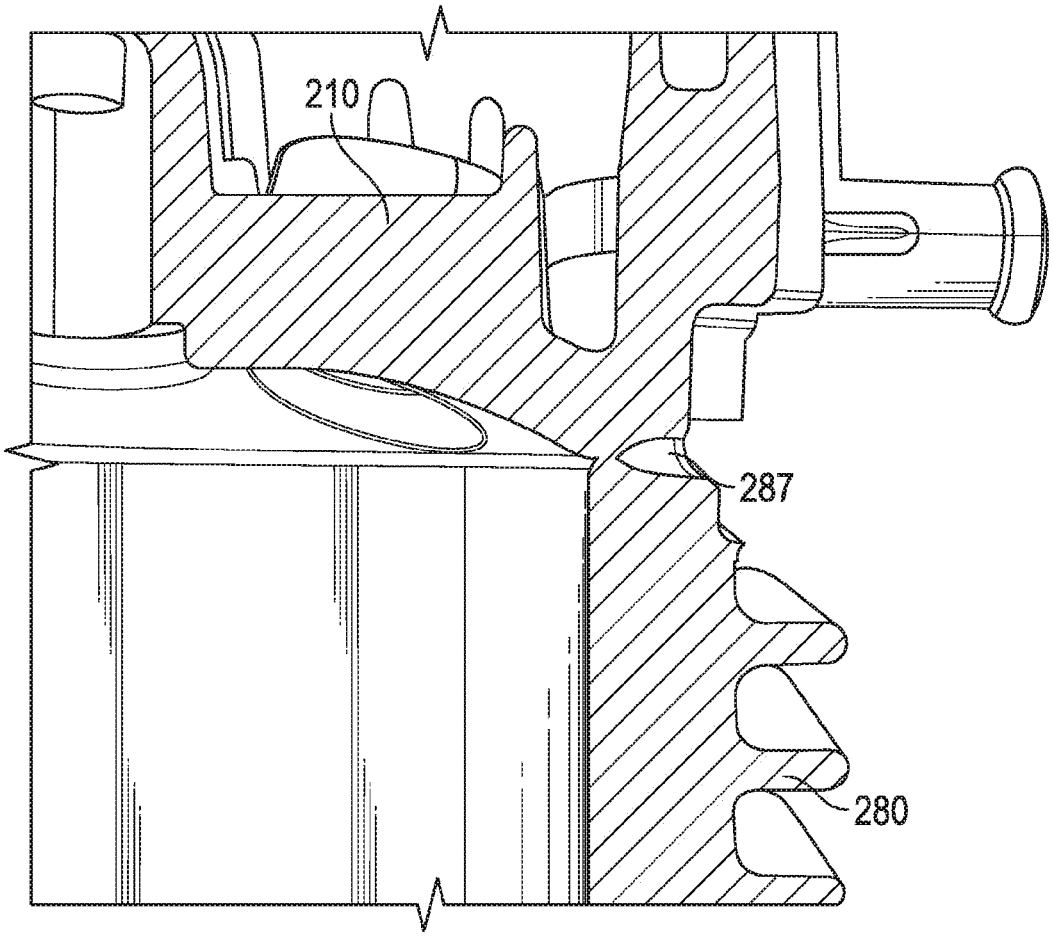
FIG. 7 is a sectional view of the cylinder head of FIG. 4 laser welded to the engine block of FIG. 2.

The cylinder head 210 includes an end face or mounting surface 280 having a cylinder wall thickness 285. In some embodiments, the cylinder wall thickness 285 is substantially constant. The mounting surface 280 is configured to mate with (e.g., engage, abut) the mounting surface 240 of the cylinder block 220 so that the cylinder head 210 may be welded to the cylinder block 220. A laser weld 287 of the cylinder head 210 to the cylinder block 220 is illustrated in FIG. 7. The cylinder head 210 also includes one or more cooling fins 290. An intake port 295 and an exhaust port 300 are formed in the cylinder head 210. A valve seat is secured to the bottom of the cylinder head 210 at a valve seat mounting location 305, 310 around an aperture (e.g., opening) to each of the intake port 295 and the exhaust port 300. In some embodiments, the valve seats are welded to the cylinder head 210 (e.g., laser welded, friction welded, MIG welded, TIG welded). An aperture or opening 315 for receiving a spark plug is also formed in the cylinder head 210.

Welding the cylinder head 210 to the engine block 205 eliminates the need for a head gasket (e.g., the head gasket 130). A head gasket is porous. During operation of an engine, oil is trapped in the pores of the head gasket (e.g., the gasket wicks oil from the cylinder bore into the gasket). This trapped oil is burned off during operation of the engine. Eliminating the head gasket eliminates this source of oil loss due to oil burn off, thereby reducing oil consumption, and improves emissions by eliminating this source of burnt oil. Despite being optimized to allow heat transfer therethrough, the head gasket acts as an insulator between the cylinder block and the cylinder head. Eliminating the head gasket therefore improves heat transfer between the cylinder block and the cylinder head by eliminating the insulative effect of the head gasket. Eliminating the head gasket also eliminates the need to service or replace the head gasket.

Welding the cylinder head 210 to the engine block 205 also eliminates cylinder bore distortion caused by the clamping force applied by the bolts used in a bolted connection between the cylinder block and the cylinder head in a standard small air-cooled engine (e.g., the engine 100).

Welding the cylinder head 210 to the engine block 205 allows the structure (e.g., the shape and mass) of these connections to be modified to utilize less material (e.g., less mass) than standard small air-cooled engines (e.g., the engine 100). This helps to reduce thermal distortion related to the substantial mass found at or near these connections in standard small air-cooled engines. The mass of material needed at this connection may be reduced (e.g., by eliminating the mounting locations 135, 140 of the engine 100). This reduction in material allows for an increase in the surface area of the external cooling fins (e.g., the cooling fins 245), by allowing the cooling fins to extend fully around the exterior of the cylinder bore, as opposed to the truncated cooling fins typically found on standard small air-cooled engines (e.g. the engine 100). The reduction in material and increased cooling fin surface area also reduces the thermal expansion as this connection, thereby reducing the likelihood of failure modes associated with thermal expansion. The reduction in material improves temperature distribution throughout the cylinder block and cylinder head assembly, thereby reducing hot spots during operation of the engine. The reduction in material also reduces cost and weight of the engine block and the cylinder head. In some embodiments, the reduction in material results in an engine that uses 1.3 pounds less aluminum than a standard small air-cooled engine. In some embodiments, the material used for the cylinder head is reduced by about 50%. The reduction in material also allows inlet port of the cylinder head to be positioned closer to the periphery of the cylinder head than in a cylinder head for a standard small air-cooled engine. This positioning of the inlet port keeps the incoming air cooler and more dense.

Welding the cylinder head 210 to the engine block 205 allows for the elimination of push rod guide tubes from the engine block and allows for use of external guide tubes (e.g., the push rod housing 260). Eliminating the push rod guide tubes from the engine block removes the need for the material surrounding the guide tubes and allows for greater flexibility in the placement of the valve ports in the cylinder head.

Welding the crankcase cover 215 to the engine block 205 eliminates the need for a crankcase gasket (e.g., the crankcase gasket 197). This provides similar advantages to welding the cylinder head 210 to the engine block 205, including eliminating a possible leak point and reducing the amount of material used at this connection. Welding the crankcase cover 215 to the engine block 205 also allows for the elimination of the oil fill tube for providing oil to the crankcase and dipstick that is typically inserted into the oil fill tube to both seal the tube and provide a user with an indication of the oil level in the crankcase. Eliminating these components reduces manufacturing and supply costs because the oil fill tube does not need to be formed and the dipstick does not need to be provided.

Welding the cylinder head 210 to the engine block 205 and welding the crankcase cover 215 to the engine block 205 allows for the engine 200 or the engine block 205 to be "substantially sealed." Such a "substantially-sealed engine" or "substantially-sealed engine block" does not include a head gasket, does not include a crankcase gasket, or does not include both a head gasket and a crankcase gasket. A "substantially-sealed engine" or a "substantially-sealed engine block" may include some gaskets like a valve cover gasket sealing the valve cover to the cylinder head, an exhaust gasket sealing an exhaust pipe or muffler to the exhaust port, and/or gaskets sealing the push rod tubes (e.g., push rod tubes 265, 270) to the engine block and cylinder head, but the cylinder bore and the crankcase are permanently sealed (e.g., not accessible without destructively opening the cylinder bore and/or the crankcase). A substantially-sealed engine or engine block reduces user maintenance by eliminating or reducing the need to change the oil in the engine 200. In some embodiments, the oil in the engine 200 is never changed. A substantially-sealed engine can be filled with oil at the factory or dealer and then sealed, eliminating the possibility of a user not filling the engine with oil before starting the engine for the first time. The engine oil does not need to be changed because the possible leak points have been eliminated and the engine is able to operate at a lower engine oil temperature. The lower temperature slows or prevents oil breakdown as compared to standard small air-cooled engines (e.g., the engine 100).

The aluminum cylinder head 210 also allows the valve seats to be welded or locally alloyed to the cylinder head 210, rather than press fit as in a standard small air-cooled engine (e.g., the engine 100). Similarly, the valve guides could be welded to the cylinder head 210 rather than press fit. Welding or locally alloying the valve seats to the cylinder head reduces the chances of the valve seat loosening or becoming dislodged due to thermal expansion of the cylinder head. This can reduce the need to service or replace the valve seats. In some embodiments, the valve seats and/or the valve guides are laser welded or alloyed. In other embodiments, these components are friction-stir welded. In other embodiments, these components are MIG or TIG welded.

The aluminum engine block 205, the aluminum cylinder head 210, and the aluminum crankcase cover 215 being die-cast aluminum capable of being welded allows for additional components to be welded to the engine 200. The pump housing for the water pump of a pressure washer could be welded to the engine 200 (e.g., the crankcase cover 215 or engine block 205). The alternator housing for a generator could be welded to the engine 200 (e.g., the crankcase cover 215 or engine block 205). The deck for a lawnmower could be welded to the engine 200 (e.g., the crankcase cover 215 or engine block 205). Such additional components could be made from aluminum and welded to the aluminum engine (e.g., laser welded, friction-stir welded, TIG welded, MIG welded). Alternatively, advances in welding steel to aluminum could allow for these additional components to be made from steel and welded to the aluminum engine.

Figure 10:
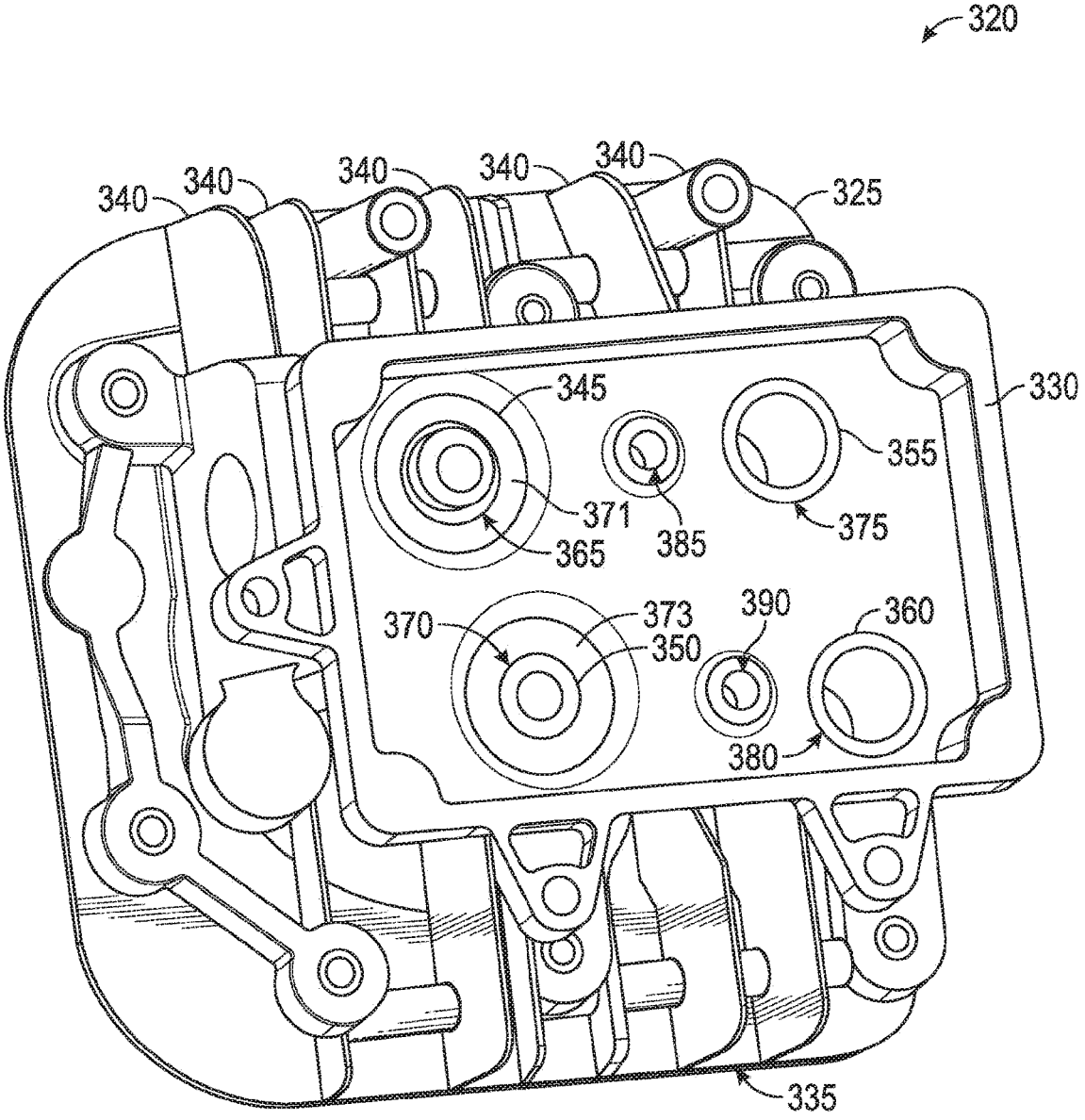
FIG. 10 is a perspective view of a two-piece cylinder head, according to an exemplary embodiment.

Referring to FIG. 10, a two-piece aluminum cylinder head 320 is illustrated. The two-piece aluminum cylinder head 320 includes an aluminum cylinder head 325 welded to an aluminum base plate or head plate 330 which forms a valve housing or "rocker box" when a valve cover is secured to the aluminum base plate 330. The aluminum cylinder head 325 is similar to the aluminum cylinder head 210 described above and includes an end face or mounting surface 335 and one or more cooling fins 340. In addition, the aluminum cylinder head 325 also includes a guide channel 345 for the intake valve, a guide channel 350 for the exhaust valve, and two push rod guide tubes 355 and 360. The valve stem of the intake valve extends through the guide channel 345 and the valve stem of the exhaust valve extends through the guide channel 350. A push rod extends through each of the push rod guide tubes 355 and 360. The aluminum base plate 330 includes valve apertures or openings 365 and 370 that receive the guide channel 345 and the guide channel 350, respectively. A valve spring seat 371, 373 surrounds the valve openings 365 and 370, respectively. A valve spring engages, rests on, or contacts each of the valve spring seats 371 and 373. The aluminum base plate 330 also includes push rod apertures or openings 375 and 380 that receive the guide tubes 355 and 360, respectively. The aluminum base plate 330 is welded (e.g., laser welded friction-stir welded, TIG welded, MIG welded) to the aluminum cylinder head 320 about the circumference of the intersections between the guide channel 345 and the valve opening 365, the guide channel 350 and the valve opening 370, the guide tube 355 and the push rod opening 375, and the guide tube 360 and the push rod opening 380. The aluminum base plate 330 also includes two rocker stem apertures or openings 385 and 390 that are each configured to receive the rocker stem to which a rocker arm is pivotably mounted. In some embodiments, the rocker stem openings 385 and 390 may extend into the aluminum cylinder head 320. In other embodiments, the rocker stem openings 385 and 390 do not extend into the aluminum cylinder head 320, which allows for the elimination of the rocker stem bosses that are commonly found on a standard cylinder head. The two-piece aluminum cylinder head 320 provides numerous advantages over a standard cylinder head that includes similar features. For a standard cylinder head, the base plate may be bolted or otherwise connected to the cylinder head with fasteners or the base plate may be integrally cast with the cylinder head. The two-piece aluminum cylinder head 320 weighs less than the standard one-piece cylinder head (e.g., saves 1.4 pounds of aluminum), which provides material and cost savings. Cycle rates and productivity may also be improved with the two-piece aluminum cylinder head 320.

Figure 11:
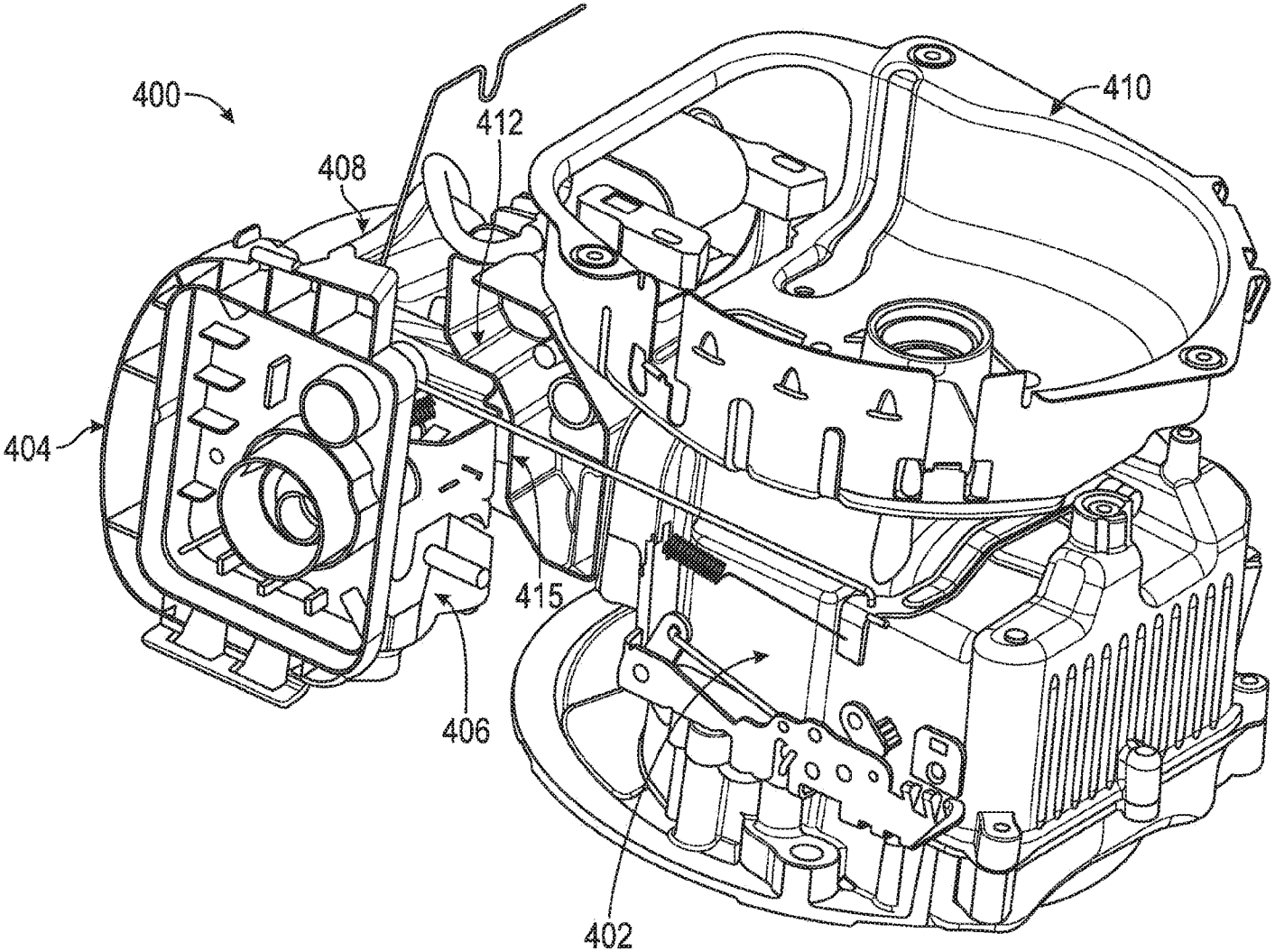
FIG. 11 is a perspective view of portions of a small air-cooled engine according to another exemplary embodiment.
Figure 12:
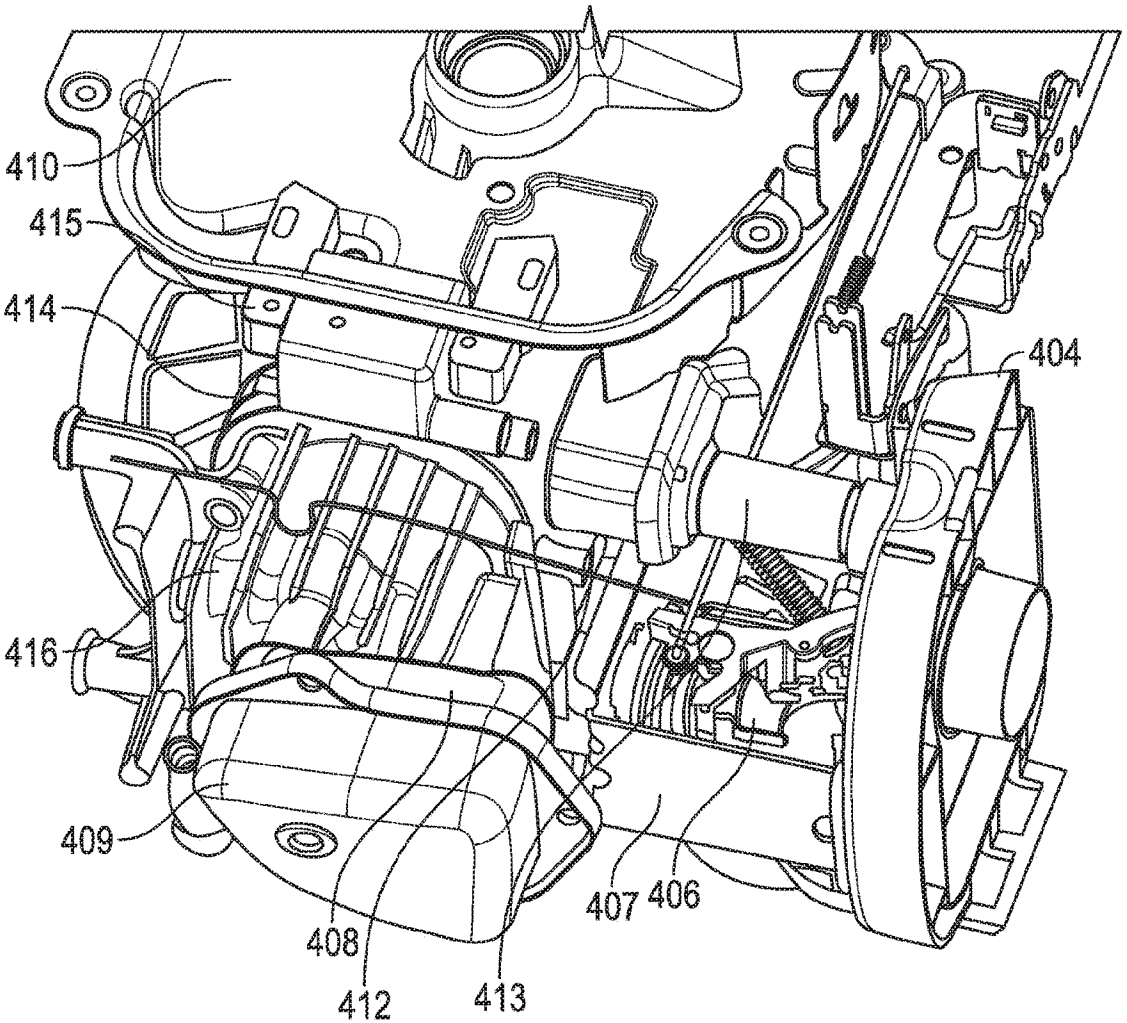
FIG. 12 is another perspective view of portions of a small air-cooled engine according to another exemplary embodiment.

Referring now to FIG. 11 and FIG. 12, another exemplary embodiment of an aluminum engine having a welded cylinder head is shown. A partial view of an engine 400 is illustrated, with some components of engine 400 removed for clarity. Engine 400 comprises an aluminum engine block 402 and an aluminum cylinder head 416. As described above, aluminum engine block 402 and aluminum cylinder head 416 are separate components joined together via welding, preferably laser welding or friction-stir welding, as described above. Unlike the conventional "blind" boring process used to manufacture aluminum engines, welding the engine block and cylinder head allows for simplified assembly because the valves, etc. may be pre-assembled in the cylinder head, while the piston, sump, etc. may be pre-assembled in the engine block. The step of welding may be the first step or the last step in the assembly process, allowing for a more customizable and streamlined manufacturing process.

Engine 400 further comprises a blower scroll 410 mounted to cylinder block 402. As with conventional air-cooled engines, blower scroll 410 surrounds a flywheel and fan (not shown) mounted to an engine crankshaft (also not shown) to allow cooling air to be effectively delivered to various regions of the engine. A plurality of cooling fins 414 encompassing a cylinder bore of engine block 402 further enable heat dissipation from engine block 402. An ignition coil interacts with magnets located within the flywheel to generate ignition signals sent to the spark plug(s) mounted in cylinder head 416. Mounted atop cylinder head 416 are a conventional head plate 408 and a conventional rocker cover 409.

Engine 400 also shows an air cleaner base 404 mounted to a bracket 407, wherein bracket 407 further holds a carburetor 406 thereon. While not shown, and air cleaner element filters ambient air that enters carburetor 406, wherein carburetor 406 delivers a metered air/fuel mixture to the combustion chamber formed by the interface of cylinder head 416 and engine block 402. Carburetor 406 is coupled to cylinder head 416 via a pushrod manifold 412 having an integrated breather chamber 415 communicating with a breather cover 413, which is in turn in communication with air cleaner base 404. Additional details of pushrod manifold 412 and its functionality in engine 400 will be further described hereinbelow.

Figure 13:
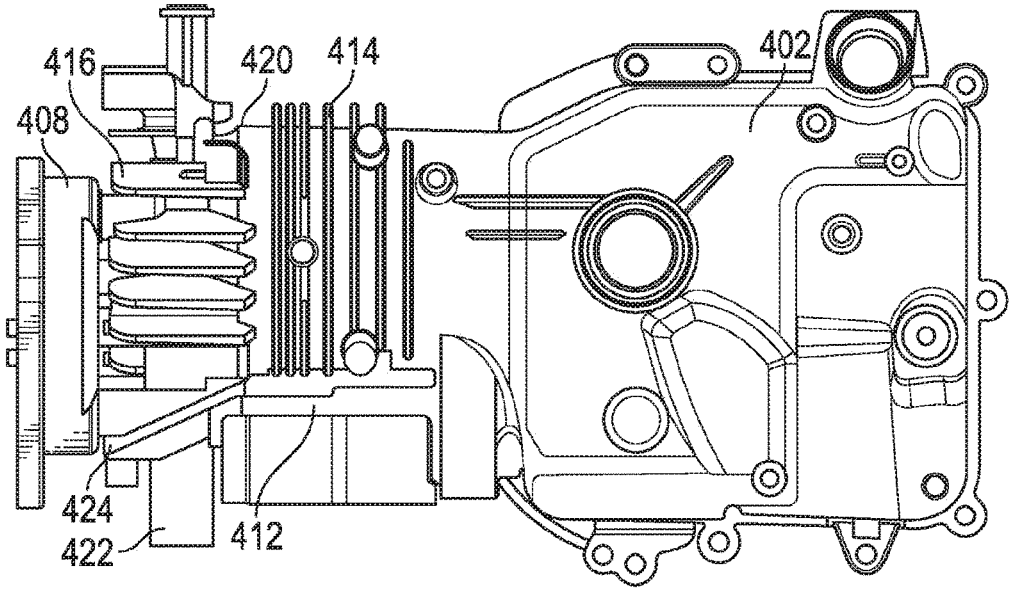
FIG. 13 is a side view of an engine block and cylinder head assembly in accordance with another exemplary embodiment.
Figure 14:
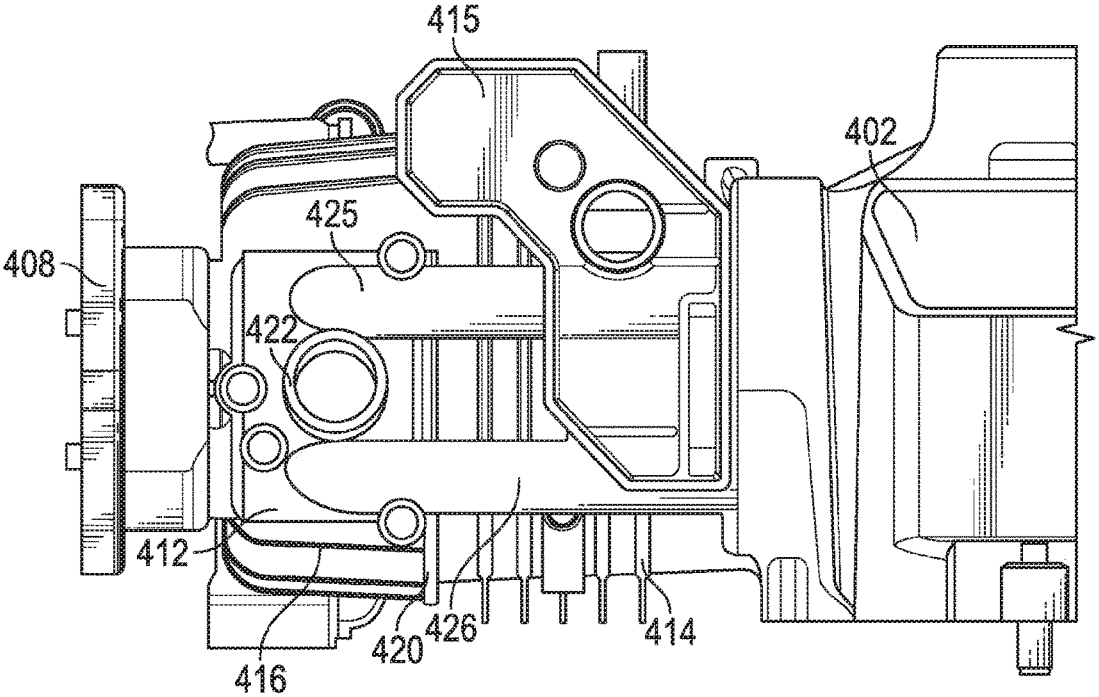
FIG. 14 is a side view of a pushrod manifold, engine block, and cylinder head assembly in accordance with another exemplary embodiment.

FIG. 13 and FIG. 14 illustrate portions of an aluminum engine having an aluminum engine block 402 coupled to an aluminum cylinder head 416 via a welded joint 420 in accordance with an exemplary embodiment. A pushrod manifold 412 is attached between engine block 402 and cylinder head 416 such that pushrod manifold 412 is a separate, removable component of the engine. Under this configuration, pushrod manifold 412 may be inserted and attached to the engine after a welding process along weld joint 420 joins cylinder head 416 and engine block 402. This allows for a continuous circumferential weld to be performed during the assembly process of the engine via, e.g., laser welding around the joint (connection, interface) between engine block 402 and cylinder head 416. In conventional engine castings, a pair of pushrod tubes are cast into the engine block and would interfere with a continuous circumferential weld operation, thus making welding of the cylinder head to the engine block much more cumbersome and less consistent, thus compromising the integrity of the weld. Alternatively, pushrod tubes 425 of pushrod manifold 412 could be press-fit into engine block 402

Pushrod manifold 412 comprises a breather chamber 415, a pair of pushrod tubes 425, 426, a carburetor adapter 422, and an angled interface 424. Breather chamber 415 communicates with the crankcase of engine block 402 to relieve internal pressure built up within engine block 402. Typically, a breather chamber is cast into the engine block and communicates with the air cleaner via a hose or other tube assembly. However, in accordance with the exemplary embodiment, the breather chamber 415 may be integrated into pushrod manifold 412 for greater ease of manufacture and additional variability. For example, a tortuous path may be added to the breather chamber 415, where such a path is quite difficult (if not impossible) to achieve in a conventional cast component. Also, forming breather chamber 415 as component of pushrod manifold 412 rather than engine block, keeps breather chamber 415 cooler, improving its performance. Breather chamber 415 communicates with air cleaner base 404 via a breather cover 413, as shown in FIG. 12. Breather cover 413 incorporates a breather tube that directly connects to the rear of air cleaner base 404. However, it is also possible for breather cover 413 to simply have a conventional tube connection to air cleaner base 404.

The pushrod tubes 425, 426 are integrally formed in pushrod manifold 412 to guide the pushrods of the respective intake and exhaust valves (not shown). Conventional engines include such pushrod guides in the casting of the engine cylinder and cylinder head. However, as described above, providing these pushrod tubes in separate pushrod manifold 412 enables better and more efficient welding of cylinder head 416 to engine block 402. Pushrod manifold 412 preferably has an angled interface 424 where it meets a matching angled surface of cylinder head 416. One purpose of this angled interface 424 is to enable the pushrod tubes 425, 426 to be assembled with the cylinder head 416 and head plate 408 installed. Another purpose of the angled interface 424 is to allow for thermal expansion of pushrod manifold 412. Pushrod manifold 412 is preferably formed of a plastic material having thermal expansion properties quite different from that of the aluminum cylinder head 416. Angled interface 424 allows for greater expansion of the plastic component without significantly altering the sealed nature of the components. Pushrod manifold 412 may be formed of, e.g., 30% glass-filled PBT (polybutylene terephthalate). However, pushrod manifold 412 may be any other plastic or polymer, or another suitable non-plastic material. In some embodiments, pushrod manifold 412 may be formed (e.g., die-cast from aluminum) as a single piece or as two or more pieces. The multiple piece pushrod manifold 412 could be welded together. Forming pushrod manifold 412 form aluminum would allow it to we welded to one or both of the engine block 402 and cylinder head 416.

Another incorporated feature of pushrod manifold 412 is a carburetor adapter 422 which extends from manifold 412 to couple the carburetor 406 to the intake passage of the combustion chamber. Typically, a separate manifold is needed to make this connection. Accordingly, pushrod manifold 412 combines what once was multiple separate components (e.g., pushrod guides, breather, breather tube, intake manifold) and incorporates them into a single, plastic component.

Figure 15:
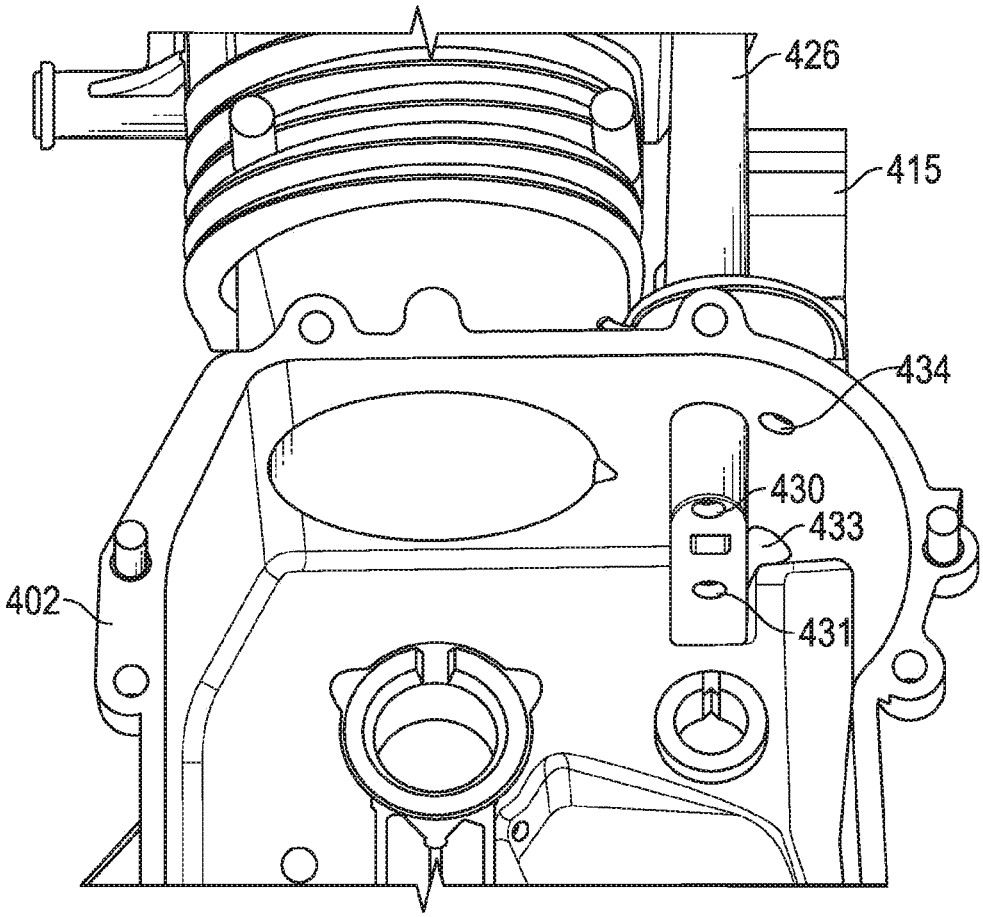
FIG. 15 is an isometric view of a portion of an engine block and pushrod manifold in accordance with another exemplary embodiment.

FIG. 15 shows an interior view of engine block 402. A pair of pushrod guides 430, 431 are located in the casting of engine block 402, as is a breather tap 433. A drain hole 434 is also formed in the casting, such that any oil that enters pushrod manifold 412 and its incorporated breather may drain back into the sump of engine block 402.

Figure 16:
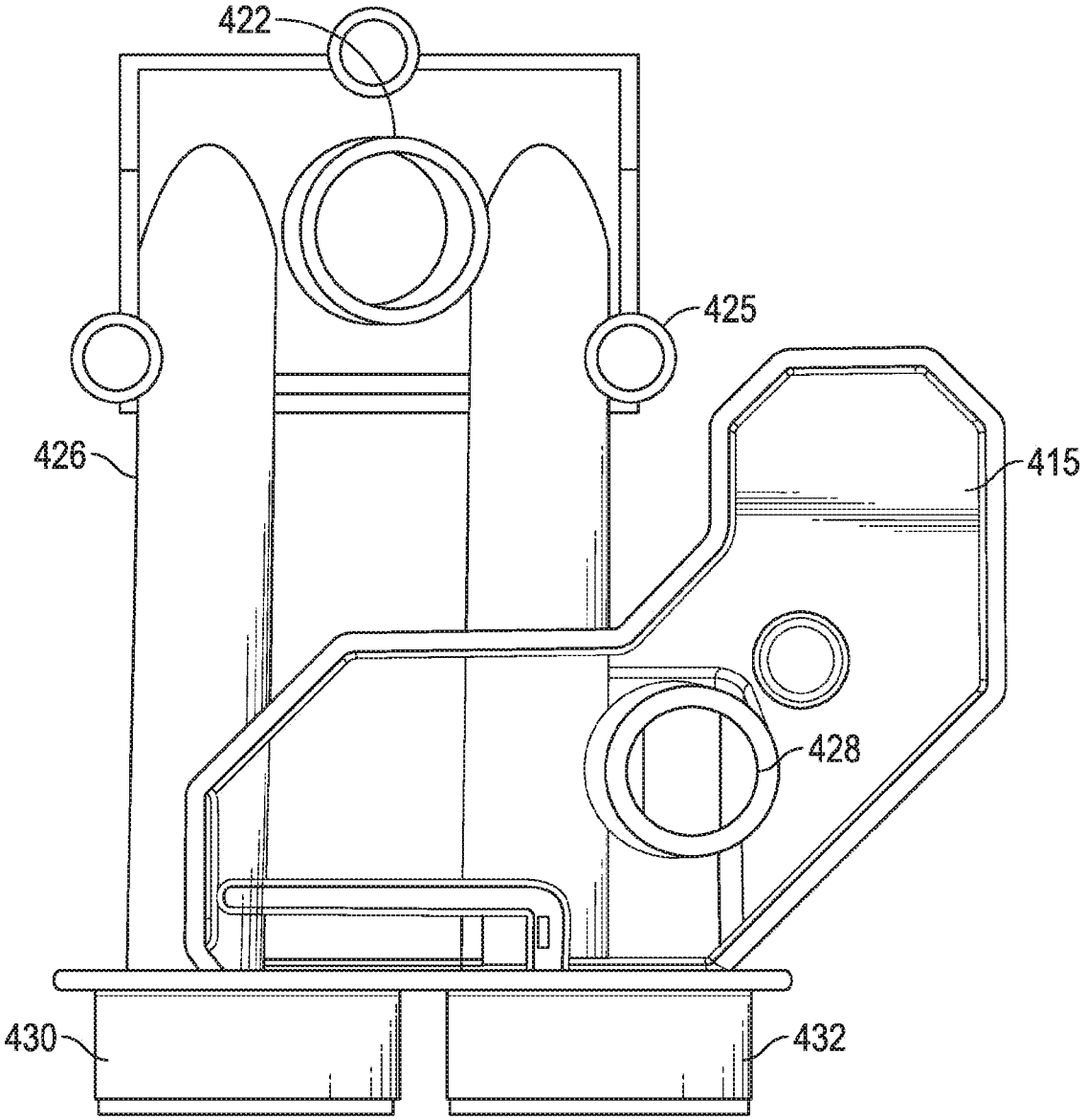
FIG. 16 is a rear view of a pushrod manifold in accordance with another exemplary embodiment.
Figure 17:
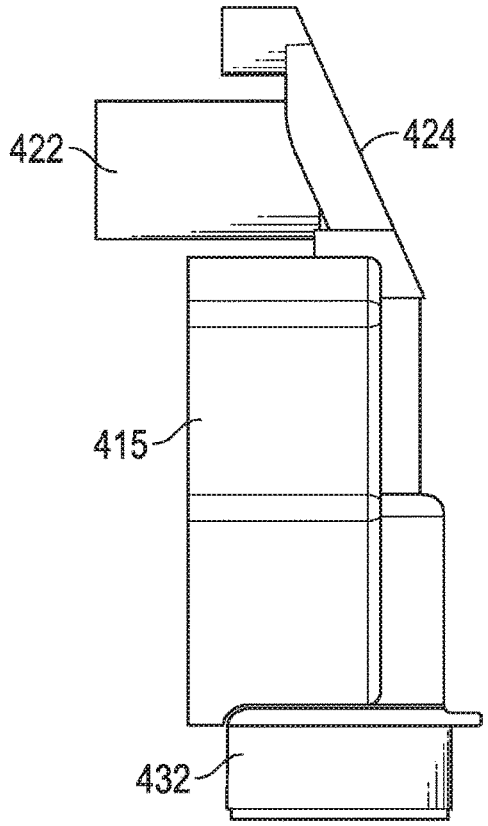
FIG. 17 is a side view of a pushrod manifold in accordance with another exemplary embodiment.
Figure 18:
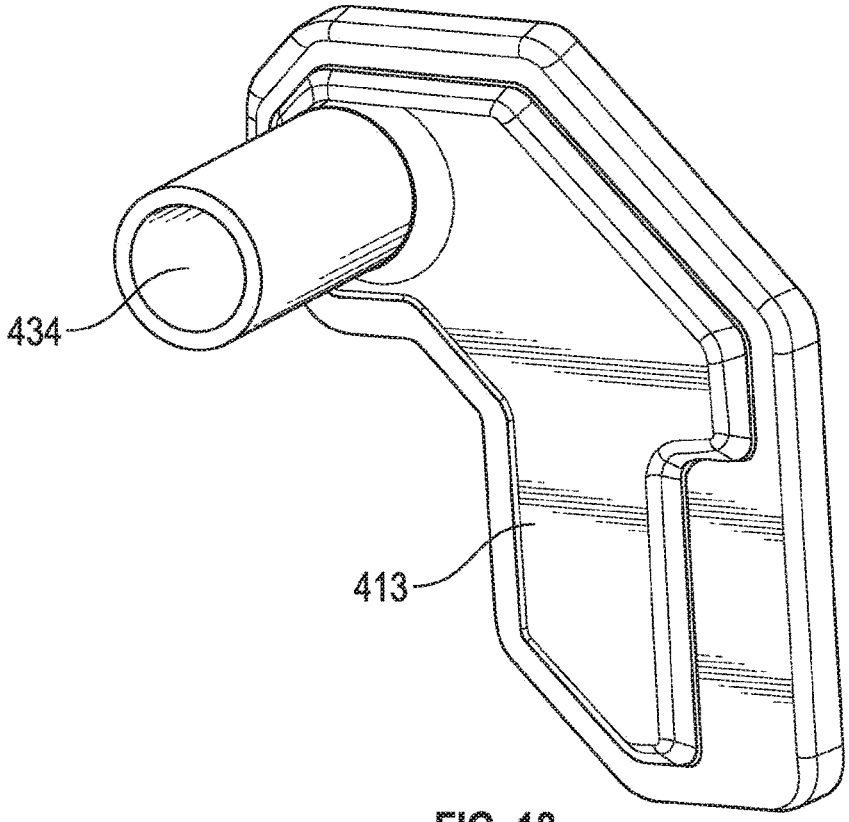
FIG. 18 is a perspective view of a pushrod manifold breather cover in accordance with another exemplary embodiment.

Referring now to FIGS. 16-17, greater detail of pushrod manifold 412 in accordance with an exemplary embodiment is shown. As described above, pushrod manifold 412 comprises a breather chamber 415, a pair of pushrod tubes 425, 426, a carburetor adapter 422, and an angled interface 424. Pushrod manifold 412 also comprises a breather reed valve location 428, wherein the breather reed valve 428 is directed towards a drain to allow oil to drain back into engine block 402. At the base of pushrod manifold 412, a pair of pushrod tube bases 432 are configured to slide into associated recesses formed in engine block 402, where the joint is sealed by an O-ring or integral gasket. This interface may allow for some movement between the pushrod manifold 412 and engine block 402 due to thermal expansion/contraction, and is thus designed for allowing such movement without unsealing the interface. FIG. 18 shows a breather cover 413 having a breather tube 434 extending therefrom. Breather cover 413 fits over breather chamber 415, allowing breather tube 434 to communicate with the air cleaner base. While breather tube 434 is shown as a molded or otherwise formed part of breather cover 413, breather tube 434 could also be a hose or other conduit connected to a hole in breather cover 413.

Figure 19:
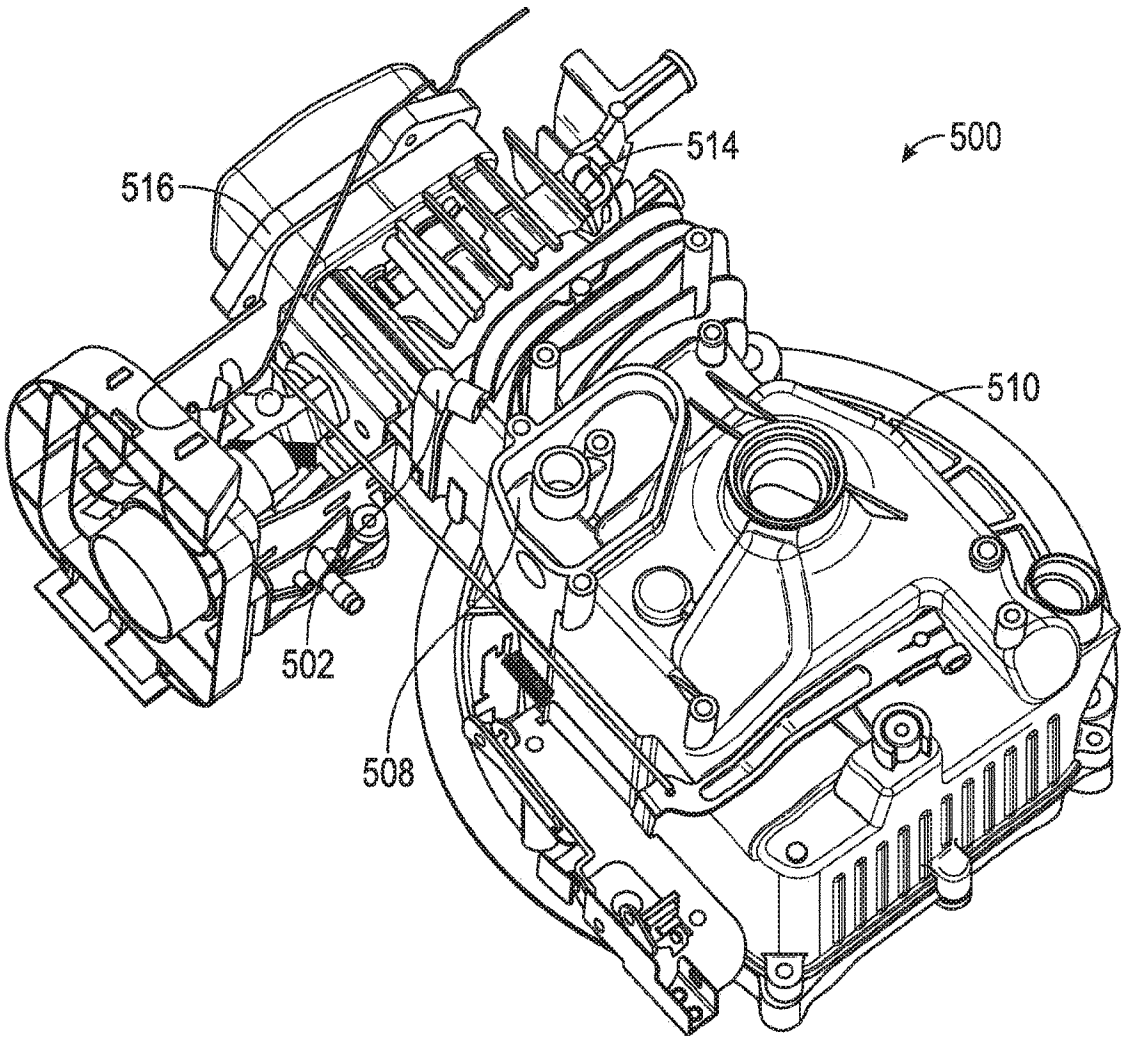
FIG. 19 is a perspective view of portions of a small air-cooled engine in accordance with yet another exemplary embodiment.
Figure 20:
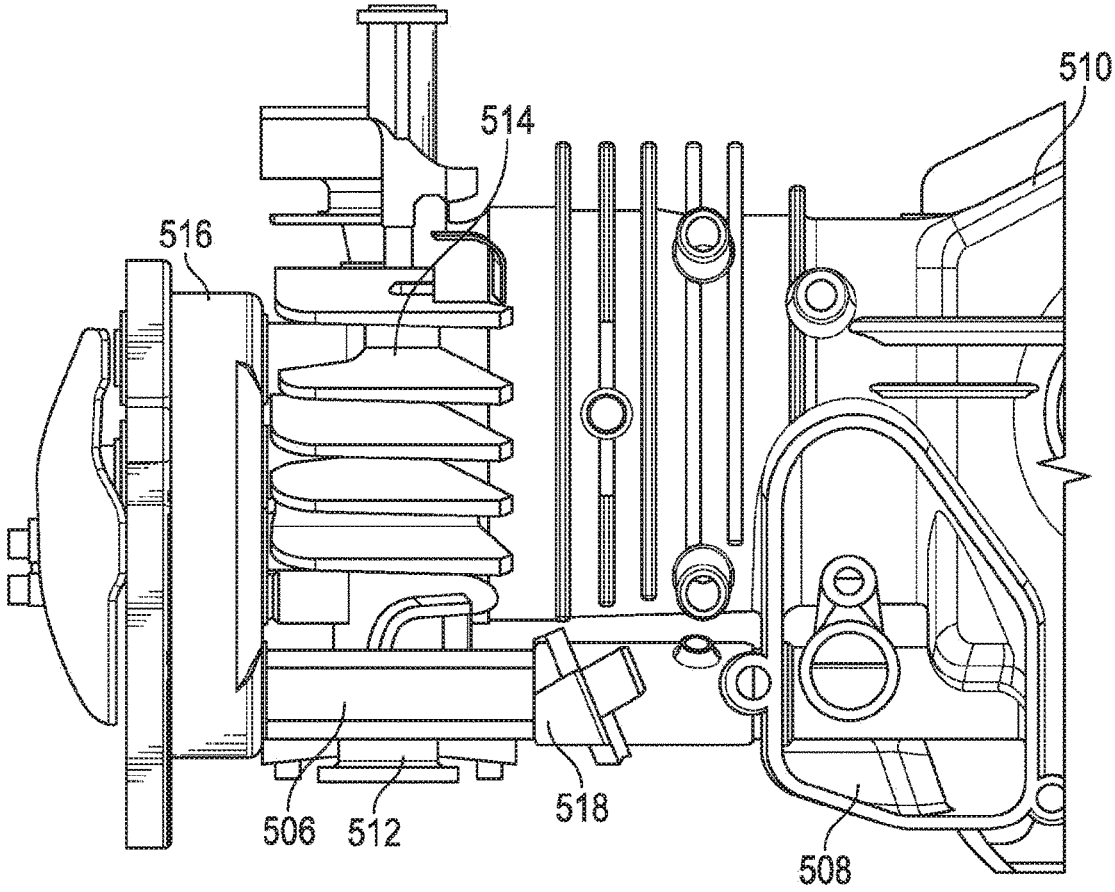
FIG. 20 is a side view of a cylinder head assembly, cylinder, and pushrod guides in accordance with yet another exemplary embodiment.
Figure 21:
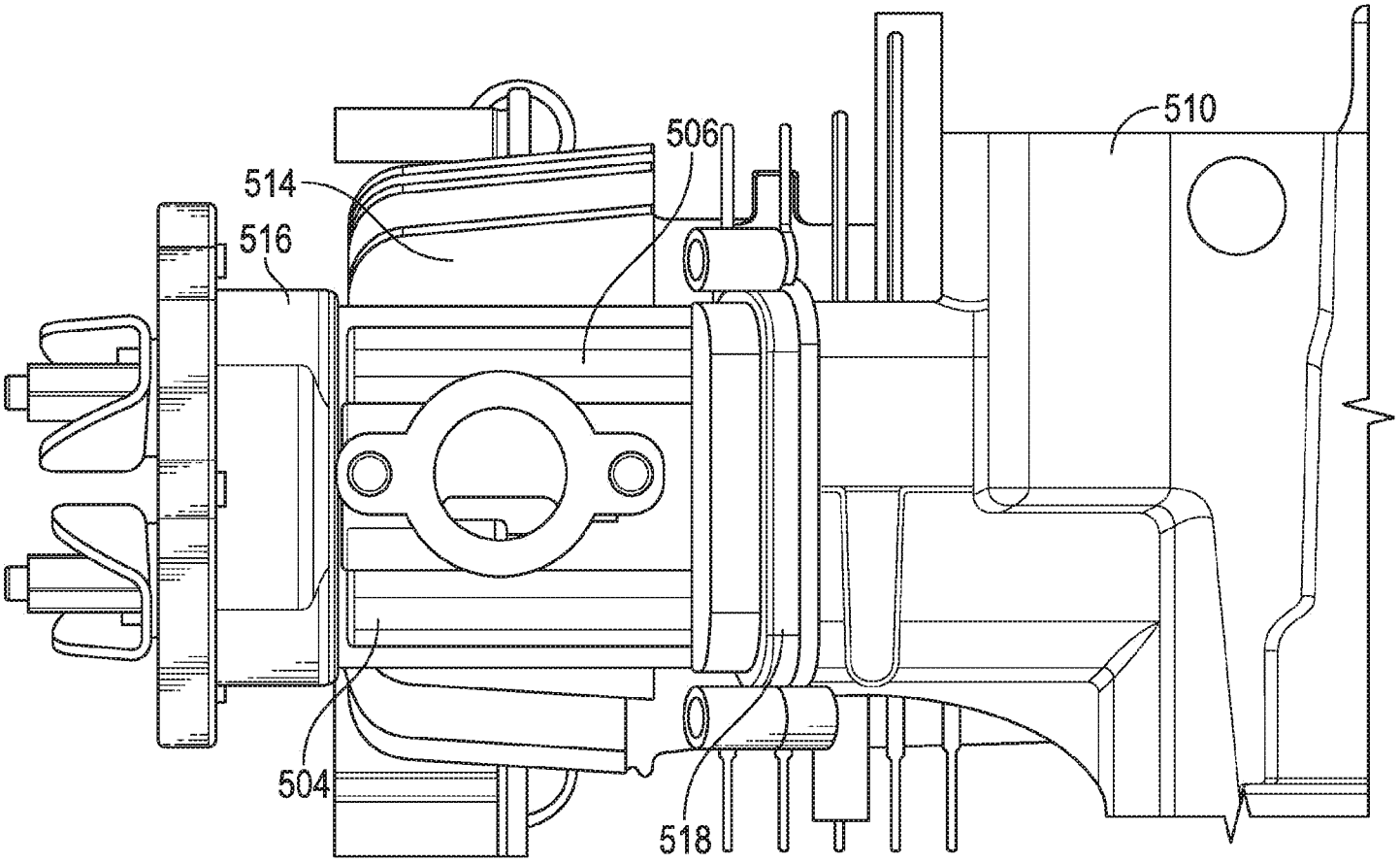
FIG. 21 is a front view of the cylinder head assembly, cylinder, and pushrod guides of FIG. 20.

Next, regarding FIGS. 19-21, an aluminum engine 500 in accordance with another exemplary embodiment is shown. As with aluminum engine 400 described above, aluminum engine 500 comprises an engine block and a cylinder head joined together via a welding operation. However, unlike aluminum engine 400, engine 500 does not utilize a pushrod manifold having an integrated breather chamber and an integrated carburetor adapter. Instead, aluminum engine 500 comprises a pushrod manifold 502 simply having a pair of pushrod tubes 504, 506 formed therein. Pushrod manifold 502 is preferably a plastic material, but may be any suitable material. Under this configuration, many components of the engine remain substantially the same as those in traditional air-cooled vertical shaft engine configurations. For example, a breather chamber 508 is cast directly into an engine block 510, while a carburetor adapter 512 is cast into a cylinder head 514. However, because pushrod manifold 502 is a separate component, it may be assembled on aluminum engine 500 after engine block 510 and cylinder head 514 are welded together via, e.g., a laser welding operation. In this way, the welding operation may be done in a single circumferential pass, which eases the manufacturing process and greatly improves the weld characteristics.

FIG. 20 and FIG. 21 show additional views of engine 500. Pushrod manifold 502 is mounted between engine block 510 and a head plate 516. The ends of pushrod tubes 504, 506 are inserted into head plate 516 and then fastened to an angled flange interface 518 on engine block 510. Pushrod manifold 502 is installed after welding of cylinder head 514 to engine block 510. A carburetor adaptor 512 extends from cylinder head 514 and between pushrod tubes 504, 506 to mate with a carburetor of the engine.

Figure 22:
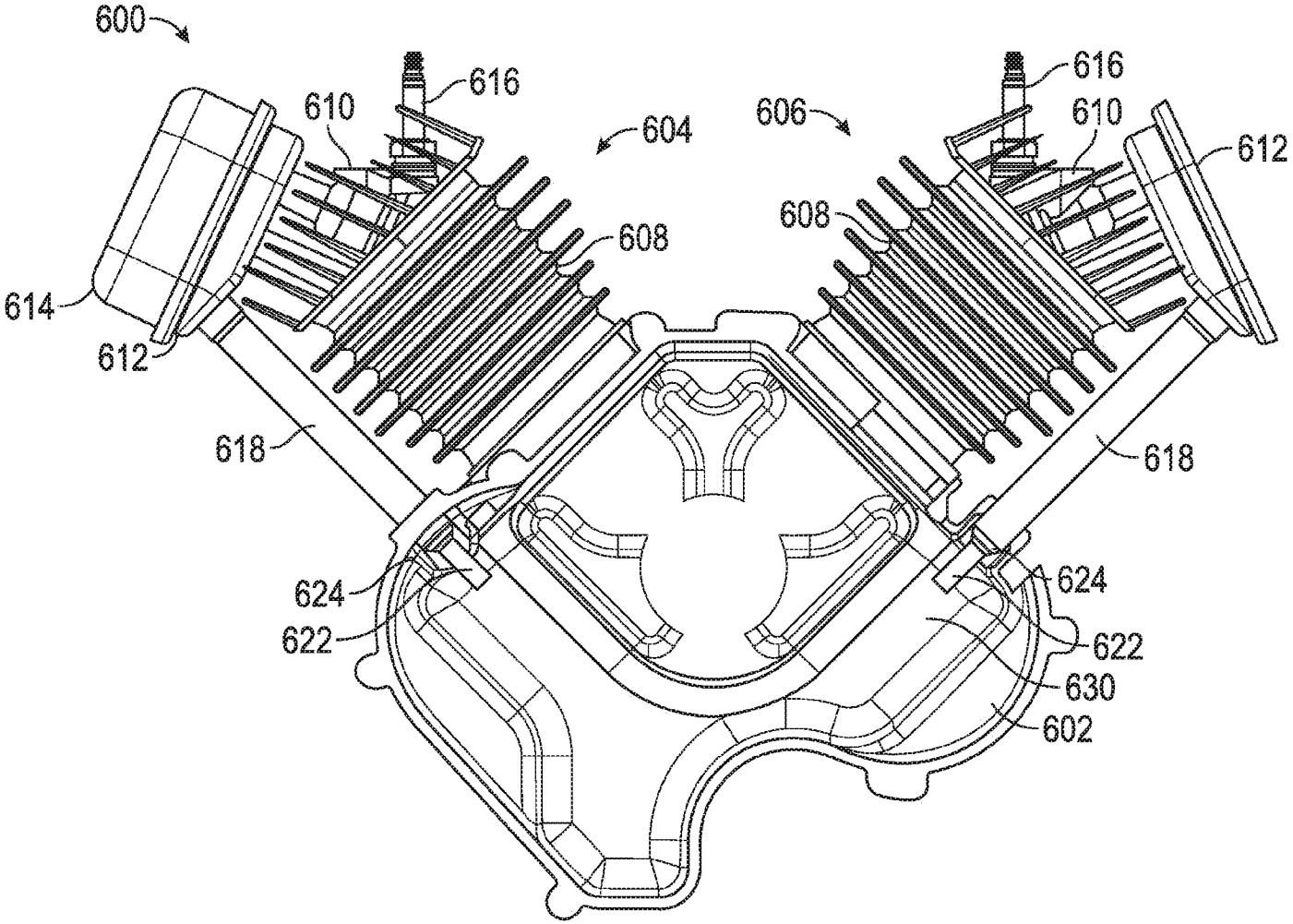
FIG. 22 is a rear view of portions of a small air-cooled engine according to another exemplary embodiment.
Figure 23:
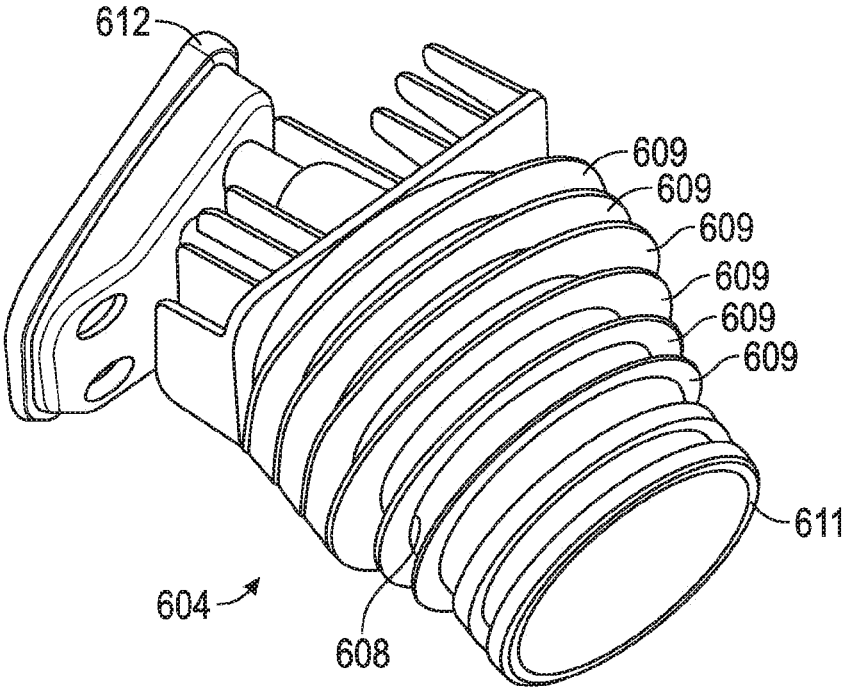
FIG. 23 is a perspective view of a cylinder assembly of the engine of FIG. 22.
Figure 24:
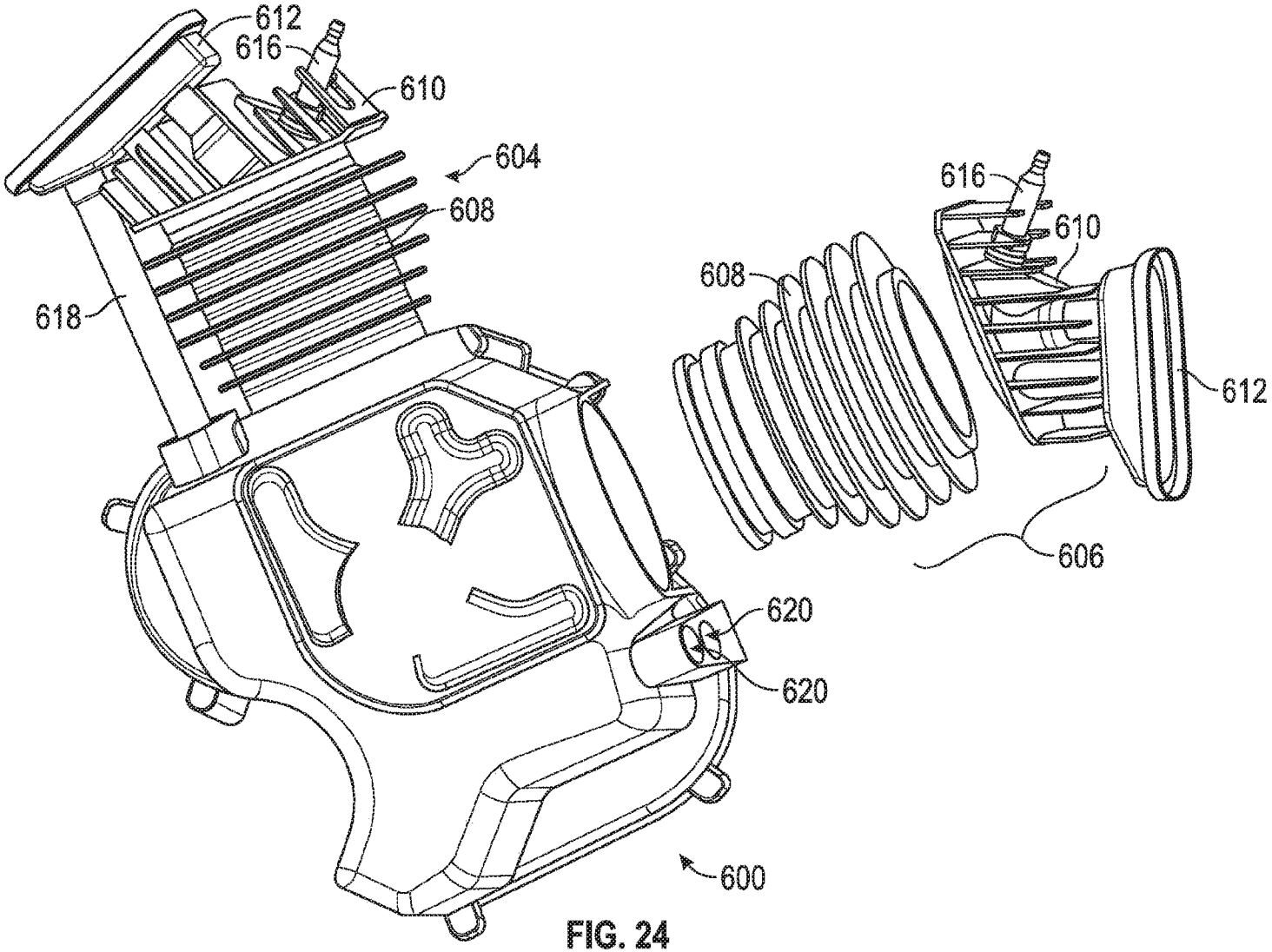
FIG. 24 is a partially exploded perspective view of the engine of FIG. 22.

Referring now to FIGS. 22-24, another exemplary embodiment of an aluminum engine is shown. A partial view of an engine 600 is illustrated, with some components of engine 600 removed for clarity. Engine 600 is a two-cylinder engine arranged in a V-twin configuration. Engine 600 includes an aluminum engine block 602 and two cylinder assemblies 606 and 606. Each cylinder assembly includes a cylinder bore 608 and a cylinder head 610. As described above, aluminum engine block 602 and cylinder assemblies 606 and 606 are separate components joined together via welding, preferably laser welding or friction-stir welding, as described above. Similarly, with reference to FIG. 23, for each cylinder assembly 604 and 606, aluminum cylinder bore 608 and aluminum cylinder head 610 are separate components joined together via welding, preferably laser welding or friction-stir welding, as described above.

The separate engine block 602 and cylinder assemblies 604 and 606 improves the manufacturability of engine 600. Welding the cylinder bore 608 and cylinder head 610 involves a relatively simple weld fixture because no additional components of the engine need to be accounted for with the fixture. Also, numerous cylinder assemblies 604 and 606 can be fabricated and inventoried for later use. It may be possible to share the same cylinder assembly among multiple engines of different sizes and even among one and two cylinder engines so that a common cylinder assembly is used with multiple engine designs. This would make assembly of the multiple engine designs more modular so that multiple engines, including one and two cylinder designs, horizontal shafted, vertical shafted, and/or engines of different displacements, could be assembled on the assembly line. Welding one of the cylinder assemblies 604 or 606 to the engine block also involves a relatively simple weld fixture because only two components (i.e., the engine block and the cylinder assembly) need to be accounted for by the weld fixture. Alternatively, a cylinder assembly could be formed with the joint or interface between the cylinder bore and the cylinder head in a different location than shown. Also, the cylinder bore and the cylinder head could be cast a single unitary component.

As shown in FIG. 23, engine bore 608 includes multiple fins 609 extending around its circumference. The relatively simple design of engine bore 608 (e.g., essentially a finned cylinder) allows it to be die-cast in a die with a relatively small number of cavities (e.g., six or more cavities), as well as simplifying the boring, honing, and welding of engine bore 608. Because cylinder bore 608 is separate from engine block 602 and cylinder head 610, cylinder bore can be machined and honed before it is welded to either of these components. This also allows cylinder bore 608 to be clamped about its outer diameter, which improves locating of cylinder 608 for the machining operations and reduces the amount of machining stock cast as a component of cylinder bore 608. The engine block end of cylinder bore 608 may include a lead-in chamfer 611 to allow relatively easy installation of a piston ring onto cylinder bore 608. Piston ring may be installed before or after the cylinder assembly is welded to the engine block.

Referring to FIG. 22, cylinder head 610 is also able to be die-cast in a die with a relatively small number of cavities (e.g., four cavities). As illustrated, cylinder head 610 is arranged for tilted or angled valves (i.e., angled relative to longitudinal axis of cylinder bore 608); however a conventional valve layout may also be used.

Each of the two cylinders also includes a head plate 612, a rocker cover 614, a spark plug 616, and a pair of pushrod tubes 618. Head plate 612 may be formed from aluminum and welded to cylinder head 610. In some embodiments, head plate 612 and/or spark plug 616 may be attached the cylinder assembly (606 or 606) prior the cylinder assembly being welded to engine block 602.

Figure 25:
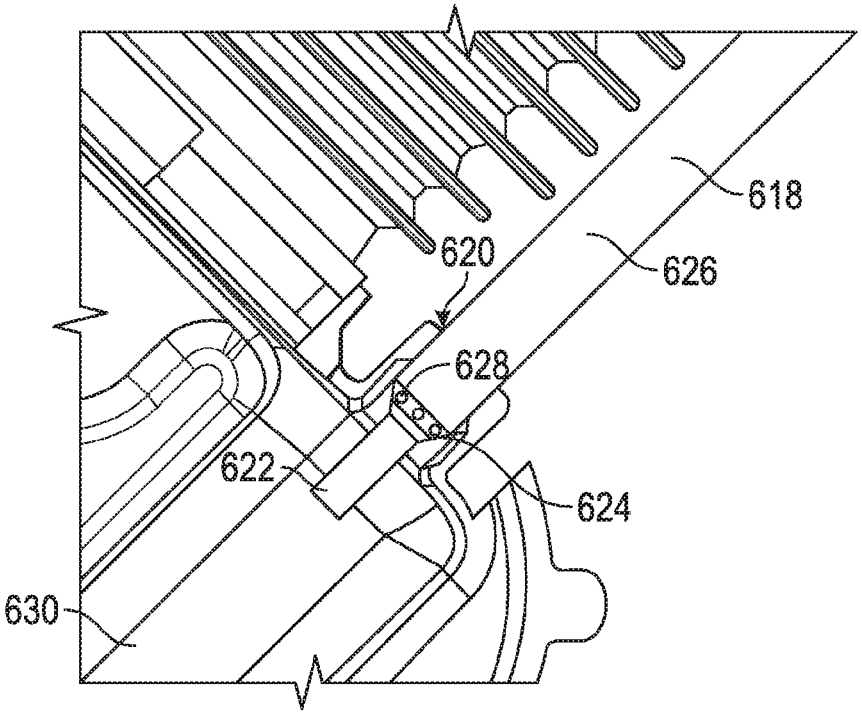
FIG. 25 is a detail view of a portion of the engine of FIG. 22.

Pushrod tubes 618 are assembled into the engine after cylinder assemblies 606 and 606 have been welded to engine block 618 and head plate 612 attached to cylinder head 610. Each tube 618 is inserted through a corresponding opening head plate 612. Tube 618 is also inserted through a corresponding opening 620 formed through a wall of cylinder block 602. As shown in FIG. 25, the end of the tube 618 inserted into engine block 602 includes a reduced diameter portion 622 that functions as a tappet guide for the push rod. The transition portion 624 between the main body 626 of tube 618 and portion 622 includes one or more holes 628, which allows oil to flow through tube 618 between engine block 602 and cylinder head 610. Push rod tube 618 being separate from cylinder assemblies 606 and 606 and being assembled into engine 600 after cylinder assemblies 604 and 606 allows welding access to the full circumference of the interface or joint between cylinder bores 608 and engine block 602, simplifying this welding operation.

Including tappet guides as integral components of pushrod tubes 618 also simplifies engine block 602. Tappet guides extending into crankcase 630 do not need to be formed as part engine block 602. This along with cylinder bores 608 and their fins 609 being separate from cylinder block 602 allows for cylinder block 602 to be die-cast in a die with a relatively small number of cavities (e.g., two cavities). A similar design for a single cylinder engine could also be die-cast in a die with a relatively small number of cavities (e.g., three cavities). As illustrated, crankcase 630 is arranged to accommodate two camshafts, one for each cylinder.

Regarding the aluminum engines discussed herein (e.g., engines 200, 400, 500, and 600), additional components may be formed from aluminum and welded to the rest of the engine. These components may include an oil sump or portion thereof and a crankcase or portion thereof welded to the engine block, the head plate, valve seats, valve guides, etc. The sump may be designed for use in a particular end product. For example, for a pressure washer the sump could include a portion of the housing for the water pump of the pressure washer. For example, for a generator, the sump could include a portion of a housing for a belt or other transmission device. Alternatively, the pump housing or belt or transmission housing could be formed from aluminum and welded to the sump. A crankshaft for use with the engines may be formed from multiple aluminum components and welded together. Additional aluminum components could be welded to an aluminum power takeoff ("PTO") of the crankshaft. These components include an air pump, a blower, a cooling fan, etc.

Both vertical and horizontal shafted designs of the aluminum engines are contemplated. The vertical and horizontal shafted designs would share many of the same components (e.g., cylinder assemblies, pushrod manifolds, pushrod tubes, etc.), thereby improving manufacturability of multiple designs in a single location.

Regarding the welding of the various aluminum components of the engines, the weld joint between components may be circular or other appropriate shapes. The welding process can follow the entire circumference of the joint (i.e., all 360 degrees, whether circular or other shapes) a single time, or multiple times (i.e., a 720 degree welding pass). Making multiple passes may reduce problems associated with poor welds and may allow castings with less than ideal material characteristics (e.g., gas porosity levels) to be used in making the engines. Though laser welding is primarily discussed herein, other types of welding may be used including friction stir welding, electron beam welding, TIG welding, and MIG welding. Friction stir welding may introduce distortion due to the relatively high pressures associated with this type of welding. TIG welding may introduce distortion due to the relatively high localized heating associated with this type of welding. The welding operations may be conducted from either side (e.g., inside or outside, top or bottom) of the components being welded. For example, the welding operation for joining the cylinder bore to the cylinder block may be accomplished from the outside of the cylinder block or from the inside (i.e., crankcase portion) of the cylinder block. Also, space may be provided between the components being joined to allow for the welding operation. In some embodiments, wire could be fed into this space to fill the space between the components. Wire-filled welding may also allow for the use of castings with less than ideal material characteristics (e.g., gas porosity levels) to be used in making the engines.

The joints between the components being welded can take different forms (e.g., butt joints, rabbet joints, etc.) The components may include alignment features to help line the components up with one another. These alignment features could be visible indicators located on each component or could be physically interacting features such that the alignment feature on one component engages the alignment feature of the other component, thereby positively positioning the two components relative to one another.

An engine using the welded engine block described herein (a "welded head engine") provides several unexpected advantages over a conventional engine in which the cylinder head is bolted to the engine block in a known manner (a "bolted head engine"). The welded head engine provides for a reduction in engine-to-engine target performance variation when compared to a bolted head engine. This may be because the welded head engine requires less break-in time than a bolted head engine. Break-in occurs due to wear and friction, particularly on the piston rings, as the engine is first used. Engine performance, including horsepower and torque, may vary when comparing a new engine to a broken-in engine.

Welded head engines tested by Applicant have shown more torque and horsepower than would be expected from a bolted head engine having the same targeted engine performance (e.g., an engine targeted to produce 5 foot-pounds of torque). For example, for an engine targeted to produce 5 foot-pounds of torque, the horsepower increase may be about 0.5 horsepower relative to a bolted head engine. Tests conducted by Applicant have shown that the welded head engine may improve performance by about 0.25 horsepower at 3600 revolutions per minute ("RPM") and may provide an increase of 0.3-0.4 foot-pounds of torque at 2400 RPM as compared to a bolted head engine targeted to produce 5 foot-pounds of torque.

A welded head engine also appears to provide a better vacuum seal in the cylinder than a comparable bolted head engine. In a skip fire test conducted by Applicant to check the dynamic pressure of a cylinder (a test of the pressure within the cylinder in the absence of combustion), the welded head engine showed an improvement of between 10 and 25 pounds per square inch ("PSI") in the motoring pressure when compared to a comparable bolted head engine. This appears to indicate improved sealing of the cylinder by about 5 to 10 percent relative to the performance of the comparable bolted head engine.

A welded head engine also eliminates locations for elastic deformation due to repeated heating and cooling cycles. As shown in FIG. 1, these locations include the connection joint between the cylinder head 125 and the engine block 110, the gasket 130 located at the connection joint, along the bolts 155 used to secure the cylinder head to the engine block, and the threads of the apertures 145 in the engine block 110 to which the bolts 155 are attached. In endurance testing conducted by Applicant on a welded head engine versus a comparable bolted head engine, the oil consumption of the welded head engine was less than the bolted head engine. This is believed to be due in part to reduced bore distortion due to the lack of clamping forces when the head is welded to the engine block, as well as the elimination of locations for elastic deformation discussed above, improved ring sealing, and in general, elimination of possible passages for oil to reach the combustion chamber of the cylinder from the crankcase. These all help to prevent oil from entering the combustion chamber, which leads to the loss of oil.

The welded head engine can allow the use of a breather system (e.g., breather cover 413 and breather chamber 415) in which there is less oil carryover than the breather system of a bolted head engine. This is due to the larger volume of the breather system than that found on a comparable bolted head engine. The larger volume allows for a decrease of air velocity within the breather, which allows the oil to separate out of the air in the breather and drain back to the cylinder. In a conventional bolted head engine, the breather system is part of the casting, so there are practical limits on the volume of the breather system (e.g., the breather system must fit in the casting with the other required components of the engine block and all of the components must be arranged in a geometry that is castable). These limits not present in the welded head engine. Because the welded head engine is not necessarily subject to these design constraints, there is more flexibility available in the design of the breather chamber in the welded head engine (e.g., breather cover 413 and breather chamber 415). When a plastic breather chamber, as described herein is used, the volume of the breather chamber can be increased relative to the volume of the breather chamber in a conventional bolted head engine and provide these advantages.

The welded head engine is also intended to provide emissions advantages over the bolted head engine. In testing conducted by Applicant, a welded head engine showed a 10-15% decrease in emissions for a comparable power output.

Figure 26:
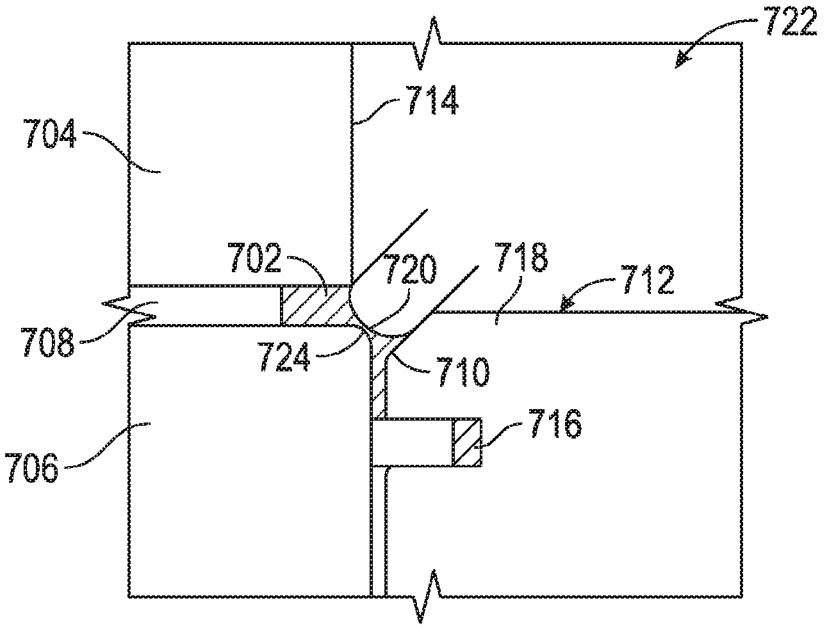
FIG. 26 (Prior Art)
FIG. 26 is a schematic cross section of a portion of a standard bolted head engine.
Figure 27:
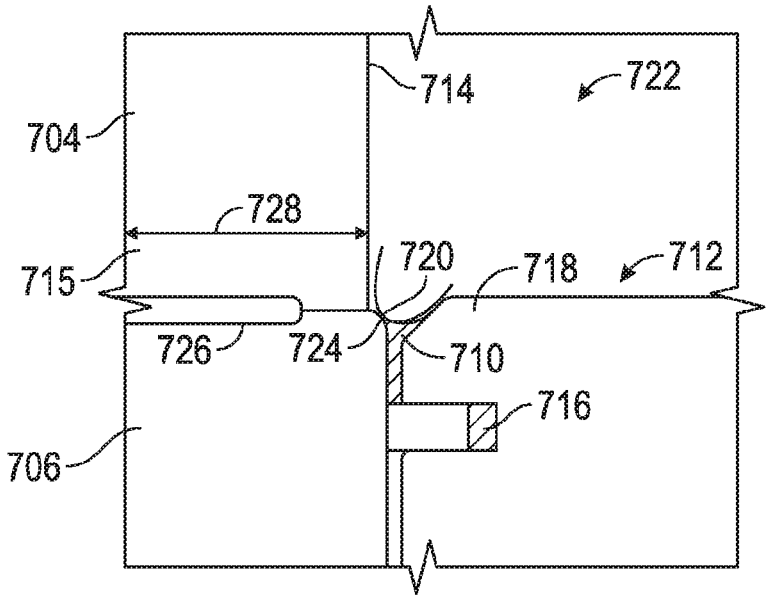
FIG. 27 is a schematic cross section of a portion of a welded head engine.

It is believed that hydrocarbon emissions are reduced in the welded head engine as compared to a bolted head engine due to a reduction in crevice volume between the engine block and cylinder head, which helps reduce oil consumption. FIG. 26 illustrates a schematic cross section of a portion of the engine block and cylinder head of a bolted head engine and FIG. 27 illustrates a schematic cross section of a portion of the engine block and cylinder head of a welded head engine to show a comparison of the relative sizes of the crevice volumes for these two types of engines. Crevice volume is generally defined as a sum of the volume of crevices in the combustion chamber of the cylinder where combustion cannot occur, because the flame front of the combusted fuel-air mixture cannot enter these crevices. Generally, crevices can be a source of hydrocarbon formation in engines. The smaller the crevices are, the lower the hydrocarbon formation.

As shown in FIG. 26, for a bolted head engine, a first crevice 702 exists between the cylinder head 704, the engine block 706, and the gasket 708 that partially fills the space (or head gasket joint) between the cylinder head 704 and the engine block 706. A second crevice 710 exists between piston 712 and the interior surface or cylinder surface 714 defined by the cylinder head 704 and the engine block 706. A third crevice 716 exists around the piston crown 718. The flame front 720 propagating through the combustion chamber 722 cannot enter the crevices 702, 710, and 716, which allows uncombusted fuel to accumulate in the crevices 702, 710, and 716. Also, the gasket 708 may be porous such that additional uncombusted fuel is absorbed by the gasket 708. The uncombusted fuel is released from the gasket 708 during the exhaust cycle of the cylinder, leading to unwanted hydrocarbon emissions.

As shown in FIG. 27, for a welded head engine, cylinder head 704 and engine block 706 are secured to one another by weld 726, thereby eliminating (or at least substantially eliminating) the first crevice 702 and allowing the gasket 708 to be eliminated. In tests performed by Applicant, the welded head engine has a total crevice volume that is about 55-60% less than the total crevice volume of the comparable bolted head engine.

Also, the size of the chamfer 724 at the joint between the cylinder head 704 and the engine block 706 can be reduced in the welded head engine as compared to a bolted head engine. In some embodiments, the length of the weld 726 at the joint between the cylinder head 704 and the engine block 706 extends for 30 to 70 percent of the total length 728 of the joint between the exterior surface 715 of the cylinder head 704 and the engine block 706 and the interior surface 714 of the cylinder head 704 and the engine block 706. The weld 726 is formed from the outside of the assembly in (i.e., from the exterior surface 715 toward the interior surface 714) as shown in FIG. 27. Applicant has discovered that this range of weld length and welding from the outside provides sufficient weld strength and integrity for the weld to survive the expected life of the engine without failing.

Figure 28:
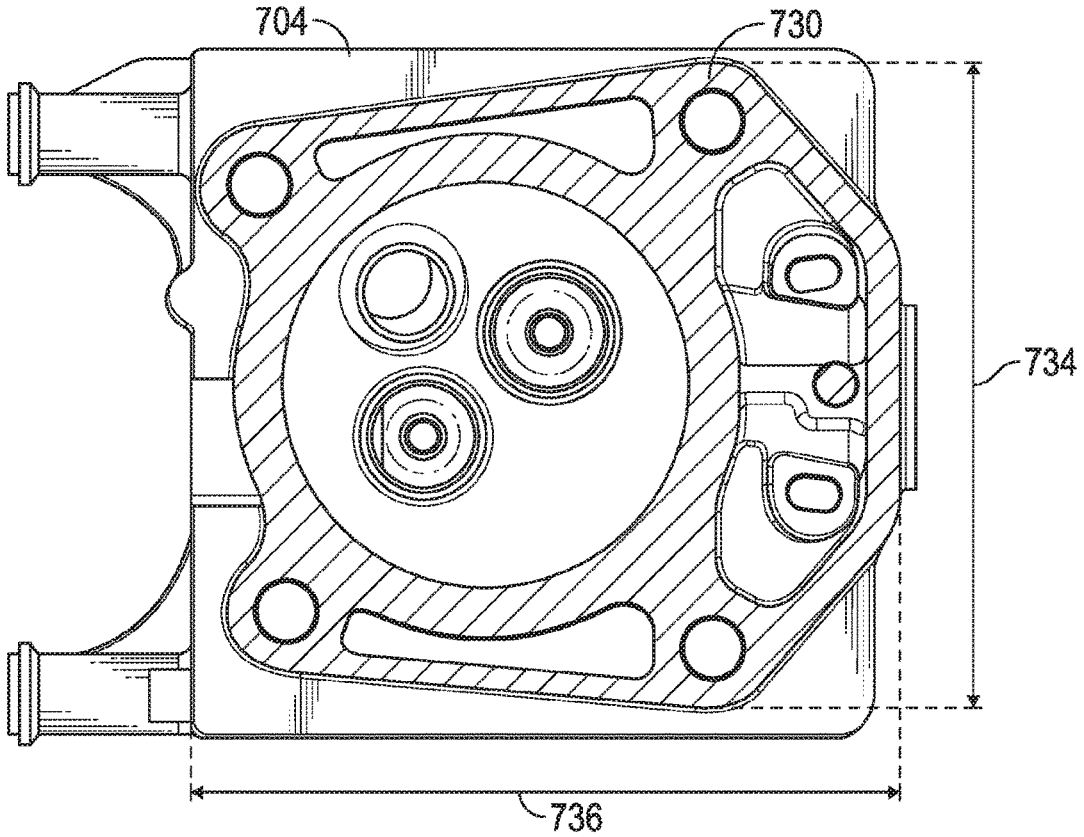
FIG. 28 (Prior Art)
FIG. 28 is a bottom view of a cylinder head of a standard bolted head engine.
Figure 29:
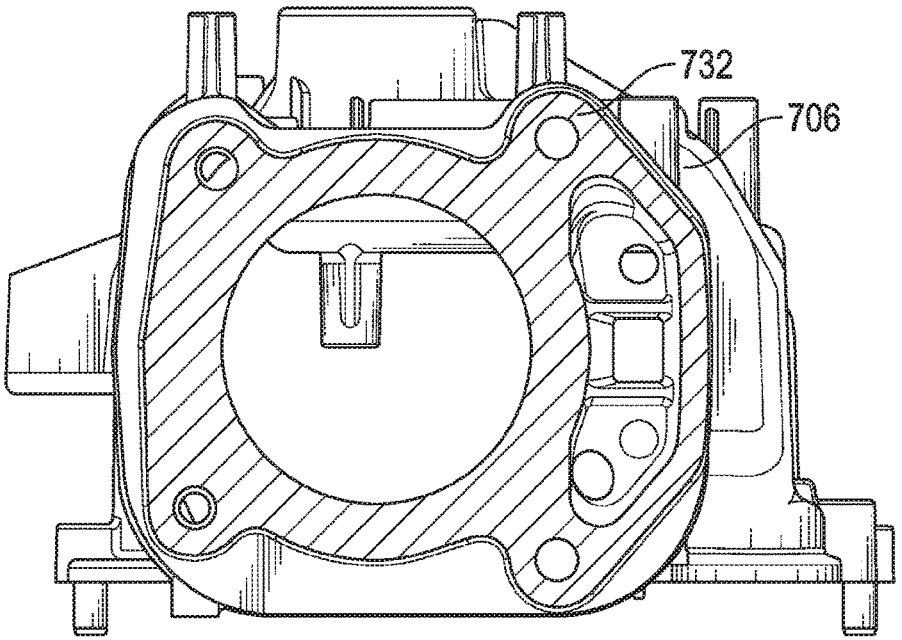
FIG. 29 (Prior Art)
FIG. 29 is a top view of an engine block of the standard bolted head engine of FIG. 28.
Figure 30:
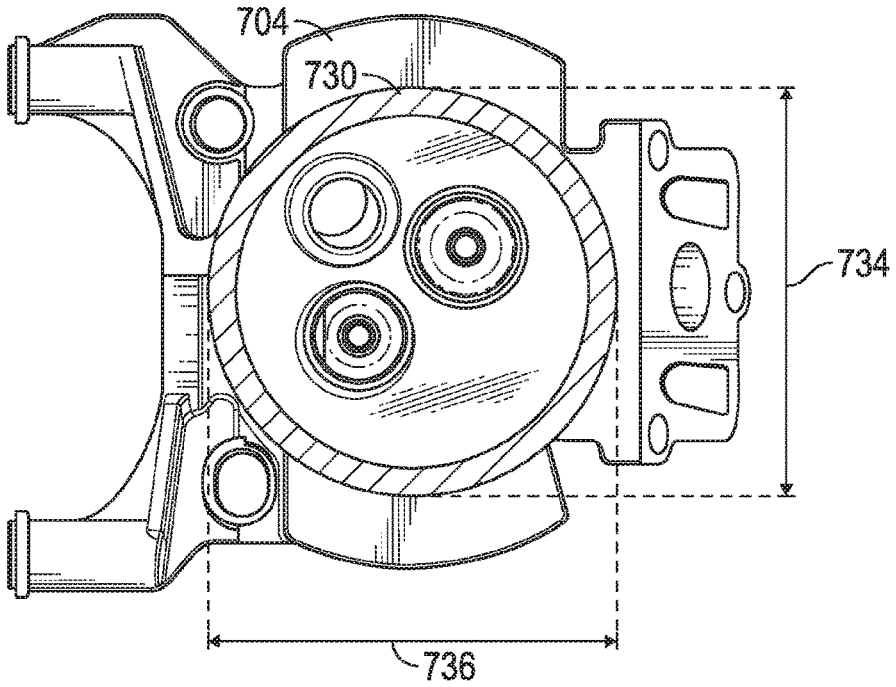
FIG. 30 is a bottom view of a cylinder head of a welded head engine.
Figure 31:
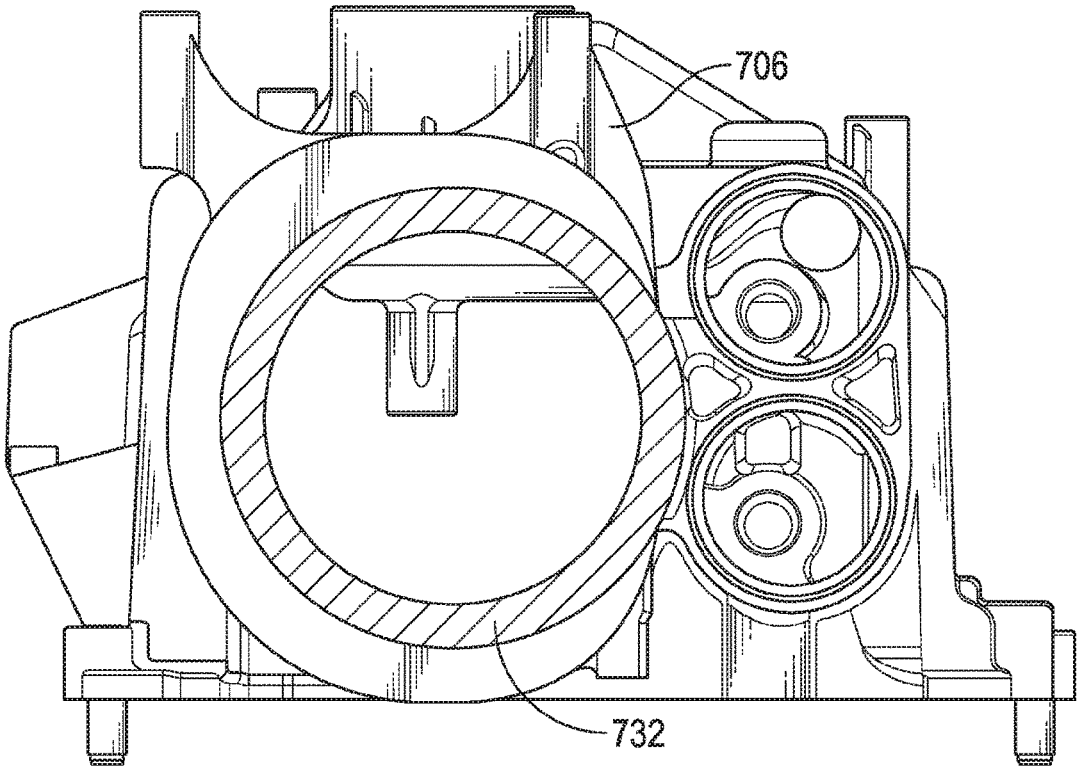
FIG. 31 is a top view of an engine block of the welded head engine of FIG. 30.

As illustrated in FIGS. 28-31, the size of the joint (i.e., the area of contact) between the cylinder head 704 and the engine block 706 is much smaller for a welded head engine than a comparable bolted head engine. The smaller joint size means there are fewer possible locations for unwanted joint surface variations in the cylinder head 704 and the engine block 706, which results in fewer potential unwanted gaps between the cylinder head 704 and the engine block 706 due to imperfect mating between the joint surface 730 of the cylinder head 704 and the joint surface 732 of the engine block 706. FIGS. 28 and 29 illustrate joint surface 730 of the cylinder head 704 and the joint surface 732 of the engine block 706 of a bolted head engine, respectively. FIGS. 30 and 31 illustrate joint surface 730 of the cylinder head 704 and the joint surface 732 of the engine block 706 of a comparable welded head engine, respectively. The joint surface 730 of the cylinder head 704 is reduced by about 67% and the joint surface 732 of the engine block 706 is reduced by about 65%. Also, the "footprint" or cross sectional size of the joint is greatly reduced for a welded head engine relative to a comparable bolted head engine. The maximum joint width 734 of the welded head engine (shown in FIGS. 30-31) is about 25% less than the maximum joint width 734 of the bolted head engine (shown in FIGS. 28-29). The maximum joint length 736 of the welded head engine (shown in FIGS. 30-31) is about 31% less than the maximum joint length 736 of the bolted head engine (shown in FIGS. 28-29). This reduction in footprint may provide significant material cost savings.

In testing conducted by Applicant, temperature differences have been observed between a welded head engine and a conventional bolted head engine. The welded head engine typically runs hotter. This may be due at least in part to a reduction in the amount of metal in the cast engine pieces to dissipate heat and also due to better heat transfer between the engine block and the cylinder head because there is no head gasket which typically would provide some insulation and limit heat transfer between the engine block and the cylinder head. Further, increased power produced by the welded head engine also leads to increased heat. These temperature increases can be mitigated by adding heat shielding or shrouds in appropriate locations. Also, the opportunity may be present to revise engine blower and shroud configurations in order to better direct engine cooling air to the cast metal components of the welded engine. Also related to temperature, the welded headed cylinder appears to provide a more even distribution of temperatures within the cylinder, or at least cause the distribution of temperatures within the cylinder to be more consistent from cycle to cycle.

The construction and arrangement of the apparatus, systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, some elements shown as integrally formed may be constructed from multiple parts or elements, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

Although the figures may show or the description may provide a specific order of method steps, the order of the steps may differ from what is depicted. Also two or more steps may be performed concurrently or with partial concurrence. Such variation will depend on various factors, including software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A small air-cooled internal combustion engine, comprising:

an aluminum cylinder block;

an aluminum cylinder head; and a weld securing the aluminum cylinder block to the aluminum cylinder head, wherein a joint having a first length is formed between the aluminum cylinder block and the aluminum cylinder head and wherein the weld extends for a second length that is at least 25% of the first length and wherein the second length is less than the first length.

2. The small air-cooled internal combustion engine of claim 1, wherein the joint extends between an exterior surface of the aluminum cylinder block and the aluminum cylinder head and an interior surface the aluminum cylinder block and the aluminum cylinder head and wherein the weld extends from the exterior surface toward the interior surface.

3. The small air-cooled internal combustion engine of claim 1, further comprising:

a plurality of cooling fins extending from a cylinder wall of the aluminum cylinder block;

wherein the plurality of cooling fins extend fully around an exterior surface of the cylinder wall.

4. The small air-cooled internal combustion engine of claim 1, further comprising:

a valve seat welded to the aluminum cylinder head.

5. The small air-cooled internal combustion engine of claim 1, further comprising:

an aluminum crankcase cover welded to the aluminum cylinder block.

6. The small air-cooled internal combustion engine of claim 1, further comprising:

a valve seat locally alloyed into the aluminum cylinder head.

7. The small air-cooled internal combustion engine of claim 1, further comprising:

an aluminum head plate welded to the aluminum cylinder head.

8. The small air-cooled internal combustion engine of claim 1, further comprising:

a second aluminum cylinder head welded to the aluminum cylinder block.

9. The small air-cooled internal combustion engine of claim 1, wherein the weld comprises a continuous circumferential weld formed around the joint between the aluminum cylinder block and the aluminum cylinder head.

10. The small air-cooled internal combustion engine of claim 1, further comprising:

a push rod manifold including a plurality of guide tubes, wherein the push rod manifold is attached between the aluminum cylinder block and the aluminum cylinder head; and a push rod positioned within each guide tube.

11. The small air-cooled internal combustion engine of claim 10, wherein the push rod manifold is formed of plastic.

12. The small air-cooled internal combustion engine of claim 10, wherein the push rod manifold includes a breather chamber.

13. The small air-cooled internal combustion engine of claim 10, wherein the push rod manifold includes a carburetor adaptor.

14. The small air-cooled internal combustion engine of claim 1, further comprising:

a pair of push rod tubes attached between the aluminum cylinder block and the aluminum cylinder head.

15. A small air-cooled internal combustion engine, comprising:

an aluminum cylinder block;

an aluminum cylinder head; and a weld securing the aluminum cylinder block to the aluminum cylinder head, wherein a joint is formed between the aluminum cylinder block and the aluminum cylinder head, wherein the joint extends between an exterior surface of the aluminum cylinder block and the aluminum cylinder head and an interior surface of the aluminum cylinder block and the aluminum cylinder head, and wherein the weld extends from the exterior surface toward the interior surface for a length less than a length of the joint between the exterior surface and the interior surface.

16. The small air-cooled internal combustion engine of claim 15, wherein the weld comprises a continuous circumferential weld formed around the joint between the aluminum cylinder block and the aluminum cylinder head.

17. The small air-cooled internal combustion engine of claim 15, further comprising:

a valve seat welded to the aluminum cylinder head.

18. The small air-cooled internal combustion engine of claim 15, further comprising:

an aluminum crankcase cover welded to the aluminum cylinder block.

19. The small air-cooled internal combustion engine of claim 15, further comprising:

a valve seat locally alloyed into the aluminum cylinder head.

20. The small air-cooled internal combustion engine of claim 15, further comprising:

an aluminum head plate welded to the aluminum cylinder head.

* * * * *